US010377033B2

(12) United States Patent
Moreau et al.

(10) Patent No.: US 10,377,033 B2
(45) **Date of Patent: *Aug. 13, 2019**

(54) METHOD OF TETHERING A TOOL

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 234 days.

This patent is subject to a terminal disclaimer.

(21) Appl. No.: 15/258,602

(22) Filed: Sep. 7, 2016

(65) Prior Publication Data

US 2016/0375575 A1 Dec. 29, 2016

Related U.S. Application Data

(63) Continuation-in-part of application No. 14/638,378, filed on Mar. 4, 2015, now Pat. No. 10,081,096.

(51) Int. Cl.
*B25H 3/00* (2006.01)
*A45F 5/02* (2006.01)

(52) U.S. Cl.
CPC ..... *B25H 3/00* (2013.01); *A45F 5/021* (2013.01)

(58) Field of Classification Search
CPC ..... B25H 3/00; A45F 5/021
See application file for complete search history.

(56) References Cited

U.S. PATENT DOCUMENTS

| | | | | |
|---|---|---|---|---|
| 3,515,798 | A | 6/1970 | Sievert | |
| 4,020,985 | A | 5/1977 | Halterman | |
| 4,174,109 | A * | 11/1979 | Gaiser | A63B 49/08 16/DIG. 12 |
| 4,476,742 | A * | 10/1984 | Midgley | A63B 49/08 74/551.9 |
| 5,373,616 | A | 12/1994 | Biersdorf et al. | |
| 6,029,321 | A | 2/2000 | Fisher | |
| 6,299,040 | B1 | 10/2001 | Matias | |
| 6,315,179 | B1 * | 11/2001 | Hillis | A45F 3/14 224/200 |
| 6,776,317 | B1 * | 8/2004 | Parker | A45F 5/00 224/250 |

(Continued)

OTHER PUBLICATIONS

Python Safety, Quick Wrap Tape Brochure (2012).*

(Continued)

*Primary Examiner* — Jeffry H Aftergut
(74) *Attorney, Agent, or Firm* — Dicke, Billig & Czaja, PLLC

(57) ABSTRACT

A tool tethering method includes the steps of providing a tool with a longitudinal portion, installing a base layer on the longitudinal portion, and providing a connector strap assembly. The connector strap assembly includes a closed-loop connector, a length of tubing, and a length of stretchable webbing secured to a connector and extending through the shrink tubing. A base layer is installed on the longitudinal portion of the tool. The length of stretchable webbing is aligned to extend along the base layer and the longitudinal portion is inserted into the tubing and substantially centered on the base layer. The tubing is caused to assume the reduced state to provide a snug fit on the hand tool, stretchable webbing, and base layer.

17 Claims, 12 Drawing Sheets

(56) References Cited

U.S. PATENT DOCUMENTS

| | | | | |
|---|---|---|---|---|
| 9,402,457 | B2 | 8/2016 | Moreau et al. | |
| 9,451,819 | B2 | 9/2016 | Mathews, Jr. | |
| 10,081,096 | B2 * | 9/2018 | Moreau | B25H 3/00 |
| 2003/0215629 | A1 | 11/2003 | Chen | |
| 2004/0182899 | A1 * | 9/2004 | Deutchman | B60R 11/06 224/410 |
| 2009/0162596 | A1 * | 6/2009 | Rios | A43B 13/04 428/45 |
| 2009/0272775 | A1 | 11/2009 | Moreau et al. | |
| 2012/0247994 | A1 | 10/2012 | Moreau et al. | |
| 2013/0175118 | A1 * | 7/2013 | McDonald | A62B 35/0018 182/3 |
| 2014/0196258 | A1 | 6/2014 | Votel et al. | |
| 2016/0257065 | A1 | 8/2016 | Moreau et al. | |

OTHER PUBLICATIONS

Python Safety, Tether Ready Pocket Reference Guide (Sep. 12, 2014).*

Non-Final Office Action for U.S. Appl. No. 14/638,378 dated Aug. 14, 2017; 13 pages.

Final Office Action for U.S. Appl. No. 14/638,378 dated Jan. 16, 2018; 10 pages.

Advisory Action for U.S. Appl. No. 14/638,378 dated Mar. 28, 2018; 3 pages.

Notice of Allowance and Examiner Interview Summary for U.S. Appl. No. 14/638,378 dated May 17, 2018; 11 pages.

* cited by examiner

METHOD OF TETHERING A TOOL

BACKGROUND OF THE INVENTION

1. Field of the Invention

The present invention relates generally to drop-prevention equipment. More particularly, the present invention relates to a method of tethering a hand tool using a connector strap.

2. Description of the Prior Art

Lanyards, tethers, hooks, and similar restraints are used to prevent the accidental dropping of tools. These restraints are particularly useful for workers at height and in environments where a tool drop can cause substantial damage or harm to equipment, to workers, or to objects below a worker who accidentally drops a tool.

One method of tethering a tool includes clipping one end of a tether to an opening in the handle of a tool (e.g., an adjustable wrench) and to clip the other end of the tether to the worker's belt or to a nearby structure. When workers properly tether a tool in this way, accidental drops can be eliminated or substantially reduced.

Some tools and equipment lack an opening, hook, or other feature that enables the user to securely attach a tether. Attempts have been made to tether wrenches, pliers, hammers and other tools by securing a connector to the tool with a leader looped through the connector and around the handle. Tools such as, for example, tubing tongs, valve wheel wrenches, spud wrenches, pipe wrenches, hammers, alignment bars and the like used in construction have posed a particular challenge since these tools often have a smooth handle, two working ends, or a handle that tapers towards one end. Such features render these tools particularly difficult for attaching and securely maintaining a tether connection on the tool.

To address this situation, one tethering method uses heat-shrink tubing to connect a connector strap to the tool, where the connector strap includes a D-ring connector. One connector strap known to some as a "web tail" is a length of nylon webbing with a first end looped through the connector and then secured to itself to attach the connector loop to the length of webbing. The first end of the webbing provides a first catch where the end of the webbing is doubled on itself. A second end of the webbing is folded or double folded on itself and then stitched together or otherwise secured in this position to define a second catch where the webbing is doubled or tripled on itself. The web tail is attached to the tool handle by using heat-shrink tubing positioned around the tool handle with the web tail between the heat-shrink tubing and the tool handle, where the first catch and the second catch are positioned outside and beyond the ends of the heat-shrink tubing. After positioning the heat-shrink tubing, the tubing is heated to constrict its size to the tool handle and web tail, thereby fixing the web tail to the tool handle.

In another approach, the user places the web tail along the handle of a tool with the catch of the doubled-over webbing facing away from the tool handle. A self-fusing silicone rubber tape is then wrapped tightly around the tool and over the web tail while also slightly stretching the tape. The tape adheres to itself to secure the web tail to the tool, thereby attaching the web tail to the tool and providing a connection point for a spring clip or other connector. This approach has been found to be satisfactory for tools having a weight below five pounds.

SUMMARY OF THE INVENTION

The above-described methods of tethering a tool using a nylon web tail-type connector strap and heat-shrink tubing or tape has been found unsatisfactory for tools weighing more than five pounds. Using tape or shrink tubing alone with a web tail has been found to have a break-away or tear-away force sufficient only for tools weighing up to five pounds. Thus, an improved method and tethering apparatus is needed with an increased weight capacity.

Another deficiency of prior-art tethering methods occurs when attaching web tails to specialty tools, such as spud wrenches. Since these tools often have a handle with a smooth and/or tapered geometry, the heat-shrink tubing can slide off the end of the handle. Thus, existing tethering methods that use tape or heat-shrink tubing alone to secure a web tail to the tool render these methods unreliable for tools having a tapered end that allows the web tail to slide off of the end of the tool. The tethering is especially unreliable for tools weighing more than five pounds. Therefore, what is also needed is an improved method of tethering rod-like objects, specialty wrenches, pipes, and other tools that lack the geometry necessary to secure a connector strap, such as an opening, protrusion, ridge, flange, or increase in size.

Accordingly, it is an object of the present invention to provide a method of tethering tools using a web tail or other connector strap. It is another object of the present invention to provide a method of tethering a tool that has increased load capacity compared to prior art tethering methods involving only heat-shrink tubing or self-amalgamating tape applied over a connector strap where the connector strap is positioned in direct contact against the tool. The present invention achieves these and other objectives by providing apparatuses and methods of tethering a tool using a connector strap.

In one aspect of the invention, a tool-tethering method includes providing a tool to be tethered, where the tool has a longitudinal portion with a substantially consistent cross-sectional size or geometry along its length. For example, a tool with a smooth and straight or gradually tapering handle is one with substantially consistent geometry along the longitudinal portion. A base layer is installed along the longitudinal portion of the tool to be tethered. A connector strap is provided and includes a length of flexible webbing secured to a closed-loop connector. The flexible webbing has a body portion, a front surface, a back surface, a first catch, and a second catch. The connector strap is positioned with the body portion axially aligned with the longitudinal portion of the tool, with the back surface disposed in direct contact with the base layer, and with the first catch and the second catch facing away from the longitudinal portion. An overwrap layer is installed over the body portion of the connector strap and a corresponding region of the longitudinal portion of the tool with the base layer.

In another embodiment of the method, the connector strap defines a closed webbing loop, and wherein the first catch is a curve of the closed webbing loop and the second catch is a second curve of the closed webbing loop.

In another embodiment in which the base layer is self-amalgamating tape, the step of installing the base layer includes wrapping the longitudinal portion of the tool with the self-amalgamating tape. In another embodiment, installing the base layer includes forming a first built-up region by wrapping the self-amalgamating tape a plurality of overlapping wraps adjacent the first catch and wrapping the self-amalgamating silicone rubber tape in a spiral from the first built-up region along the longitudinal portion of the tool a predefined distance. In some embodiments, a second built-up region is formed adjacent the second catch.

In another embodiment of the method, the connector strap has a length of flexible webbing with a first end looped through the closed-loop connector and secured to the front surface of the length of webbing, thereby securing the closed-loop connector to the length of webbing and defining the first catch adjacent the body portion. A second end is folded on itself and secured to the front surface of the length of webbing, thereby defining the second catch adjacent the body portion and spaced apart from the first catch.

In another embodiment of the method, the length of flexible webbing has a backing layer on the back surface.

In another embodiment of the method, the overwrap layer is non-reinforced self-amalgamating tape, reinforced self-amalgamating tape, adhesive tape, a length of heat-shrink tubing, a length of rubber tubing, or a length of cold-shrink tubing in a radially expanded state supported by a removable hollow core.

In another embodiment of the method in which the overwrap layer is tape, installing the overwrap layer includes forming a first built-up region by wrapping the tape a plurality of overlapping wraps adjacent the first catch and wrapping the tape in a spiral from the first built-up region along the longitudinal portion of the tool a predefined distance. In some embodiments, an additional built-up region is formed adjacent the second catch.

In another embodiment of the method, a second or additional overwrap layer is installed over the overwrap layer. In some embodiments, the additional overwrap layer is shrink tubing or rubber tubing.

In another embodiment of the method, the overwrap member is a length of cold-shrink tubing in the radially expanded state supported by the removable hollow core. Securing the overwrap member includes inserting the longitudinal portion of the tool and the connector strap into the removable hollow core, positioning the cold-shrink tubing to align with the body portion and a corresponding region of the longitudinal portion, and removing the removable hollow core to allow the cold-shrink tubing to collapse around and snugly grip the body portion of the connector strap and the longitudinal portion of the tool without overlapping the first catch or the second catch.

In another embodiment, a tethering method includes the steps of providing a tool to be tethered, where the tool having a longitudinal portion with a substantially consistent geometry along its length; providing a connector strap comprising a length of flexible webbing secured to a closed-loop connector, the flexible webbing having a body portion, a front surface, a back surface, a first catch, a second catch; positioning the connector strap with the body portion axially aligned with the longitudinal portion of the tool, with the backing layer disposed in direct contact with the longitudinal portion, and with the first catch and the second catch facing away from the longitudinal portion; and installing an overwrap layer over the body portion of the connector strap and a corresponding region of the longitudinal portion of the tool. In some embodiments, the length of flexible webbing includes a backing layer on the back surface.

In another embodiment of a tethering method, the method includes the steps of providing a tool to be tethered, where the tool has a longitudinal portion; providing tape; providing an overwrap member; and providing a connector strap. In one embodiment, the connector strap has a closed-loop connector and a length of webbing with a first end, a second end, and a body portion, where the first end is looped through the closed-loop connector and secured to the length of webbing thereby securing the closed-loop connector to the length of webbing and defining a first catch adjacent the body portion. The second end is folded on itself and secured to the length of webbing thereby defining a second catch adjacent the body portion and spaced apart from the first catch. The method also includes wrapping the tape around the longitudinal portion of the tool to form a taped tool region; positioning the connector strap with the body portion axially aligned with the taped tool region and with the first catch and the second catch facing away from the taped tool region; and installing the overwrap member over the body portion of the connector strap and the corresponding taped tool region. In some embodiments, the overwrap member is self-amalgamating tape, a length of heat-shrink tubing, a length of rubber tubing, or a length of cold-shrink tubing in a radially expanded state supported by a removable hollow core.

In some embodiments where the overwrap member is self-amalgamating tape, it is installed by wrapping the self-amalgamating tape around the middle portion of the connector strap and a corresponding region of the longitudinal portion of the tool.

In some embodiments in which the overwrap member is heat-shrink tubing, it is installed by inserting the taped tool region and the connector tab into the heat-shrink tubing, positioning the heat-shrink tubing along the majority of the middle portion and a corresponding region of the longitudinal portion without covering the first catch or the second catch, and heating the length of heat-shrink tubing, to cause the heat-shrink tubing to constrict around to the middle portion of the connector strap and the longitudinal portion of the tool.

In some embodiments in which the overwrap member is cold-shrink tubing in a radially expanded state and supported by the removable hollow core, it is installed by inserting the longitudinal portion of the tool and the connector strap into the removable hollow core, positioning the cold-shrink tubing to align with the middle portion and a corresponding region of the longitudinal portion, and removing the removable hollow core to allow the cold-shrink tubing to collapse around and snugly grip the middle portion of the connector strap and the longitudinal portion of the tool without overlapping the first catch or the second catch.

In some embodiments, the webbing of the connector strap is made of stretchable webbing, such as rubber, elastic webbing, or flat bungee cord. For example, In another embodiment, a tool-tethering method includes the steps of providing a tool to be tethered, where the tool has a longitudinal portion with a substantially consistent cross-sectional size along its length; installing a base layer along the longitudinal portion of the tool to be tethered; providing a connector strap assembly comprising a closed-loop connector, a length of shrink tubing in an expanded state and capable of assuming a reduced state, and a length of stretchable webbing secured to the closed-loop connector and defining a closed loop extending through the length of shrink tubing; installing the longitudinal portion of the tool into the length of shrink tubing with the length of shrink tubing substantially centered axially along the base layer; and causing the shrink tubing to assume the reduced state to provide a snug fit on the tool and base layer.

In yet another embodiment, a tethering method comprising the steps of providing a tool to be tethered, the tool having a longitudinal portion; providing a quantity of tape; providing an overwrap member; providing a connector strap assembly that includes a closed-loop connector and a length of stretchable webbing with a first end, a second end, and a body portion, where the first end is looped through the closed-loop connector and secured to the body portion adjacent the closed-loop connector to secure the closed-loop connector to the length of stretchable webbing and defining a first catch adjacent the body portion, and where the second end is folded on itself and secured to the body portion to define a second catch adjacent the body portion and spaced apart from the first catch; wrapping the tape around the longitudinal portion of the tool to a taped tool region; positioning the connector strap with the body portion axially aligned with the taped tool region and with the first catch and the second catch facing out from the taped tool region; and installing the overwrap member around the body portion of the connector strap and the corresponding taped tool region.

In other embodiments, the method optionally includes the steps of providing a tether having a first tether end and a second tether end, attaching the first tether end to the closed-loop connector, and attaching the second tether end to the user.

DETAILED DESCRIPTION OF THE PREFERRED EMBODIMENT

Figure 1:
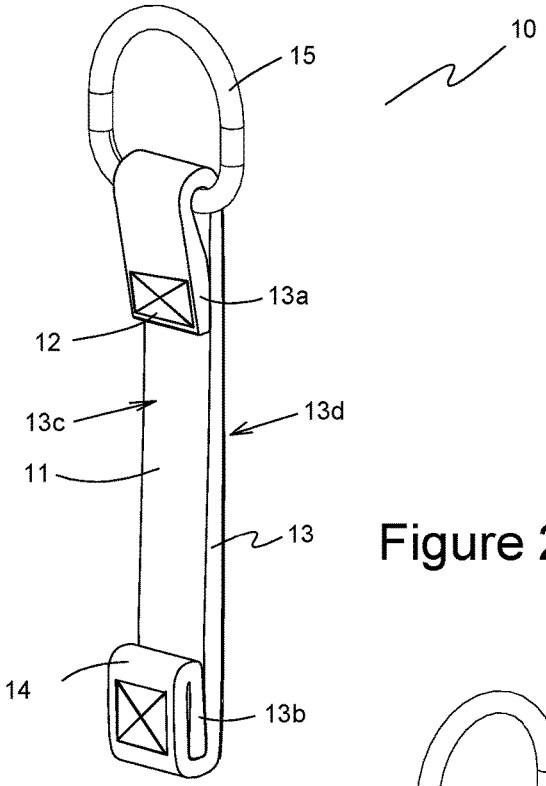
FIG. 1 illustrates a front perspective view of one embodiment of a connector strap of the present invention.

Embodiments of the present invention are illustrated in FIGS. 1-29. FIG. 1 illustrates a front perspective view of one embodiment of a connector strap 10 secured to a connector 15 suitable for attaching a tether (not shown). In the embodiment of FIG. 1, connector strap 10 includes a length of webbing 13 with a first end portion 13*a*, a second end portion 13*b*, a front surface 13*c*, and a back surface 13*d*. In one embodiment, first end portion 13*a* defines a first catch 12 and second end portion 13*b* defines a second catch 14, where body portion 11 is between first catch 12 and second catch 14.

In one embodiment, connector 15 defines a closed-loop and connector 15 is secured to webbing 13 by looping first end portion 13*a* through the closed-loop and securing first end portion 13*a* to body portion 11, such as by stitching, fasteners, adhesive or other means. Also, by attaching first end portion 13*a* to webbing 13 in this manner, first end portion 13*a* defines a first catch 12 on front surface 13*c* where first end portion 13*a* overlaps body portion 11. Second end portion 13*b* is folded on itself and secured to body portion 11, such as by stitching, to define a second catch 14 on front surface 13*c* that is spaced apart from first catch 12 by body portion 11.

In one embodiment, webbing 13 is made of woven nylon and has a width 13*w* of about ½ inch and an overall webbing length of about five inches. After folding and securing ends 13*a*, 13*b*, connector strap 10 has an overall connector strap length 13L of about three inches. Other types of webbing and different lengths, widths, and thicknesses are acceptable for connector strap 10. It is also contemplated that connector 15 may be omitted, and instead first end portion 13*a* being secured to body portion 11 defines a closed loop to which a tether (not shown) may be connected.

In another embodiment, webbing 13 is a length of flat bungee cord having a rubber core and a jacket made of polypropylene, nylon, or other materials. Examples of flat bungee cord are sold under the name Keeper® or Secure-Tite® (made by Hampton Products International of Foothill Ranch, Calif.) and CargoLoc® (made by Allied International of Sylmar, Calif.) and are available in ½-inch, ¾-inch, one-inch, and other widths. Flat bungee cord stretches to a stretched length that is 150% or more of the length of the cord in its unstretched, relaxed state. In yet other embodiments, webbing is made of natural or synthetic rubber with a width of one-half inch to one inch.

Figure 2A:
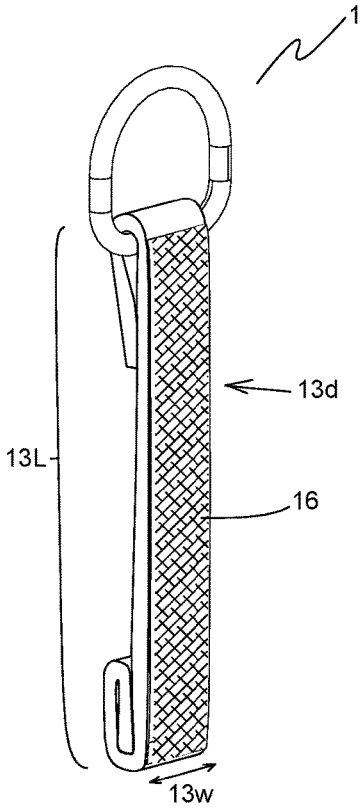
FIG. 2A illustrates a rear perspective view of an embodiment of a connector strap showing a backing layer on the back surface of the webbing.

Referring now to FIG. 2A, a rear perspective view shows connector strap 10 of FIG. 1. Optionally, connector strap 10 includes a backing layer 16 on back surface 13*d* of webbing 13. In one embodiment, backing layer 16 is silicone rubber applied in a heated, liquid form to back surface 13*d* of webbing 13. In another embodiment, webbing 13 is provided with back surface 13*d* intermittently coated along its length with backing layer 16. Webbing 13 is then cut between sections coated with backing layer 16, and connector strap 10 is assembled, for example, to include first and second catches 12, 14 as discussed above.

Molten polymers such as silicone rubber are believed to adhere to webbing 13 by occupying voids and depressions in webbing 13 and/or by surrounding fibers of webbing 13. Backing layer 16 provides an improved frictional grip between connector strap 10 and an implement 5 (e.g., steel tool handle) compared to webbing 13 that has no backing layer 16. Backing layer 16 may be secured to webbing 13 using other methods, such as stitching or adhesive. In one embodiment, backing layer 16 extends completely across the width 13*w* of back surface 13*d*. In other embodiments, backing layer 16 extends partially across the width 13*w* of back surface 13*d*.

In other embodiments, webbing 13 is coated on a plurality of sides or encased with a polymer coating made of vinyl, rubber, thermoplastic polyurethane, or plastic. One example of polymer-coated webbing is polyethylene webbing encased in thermoplastic polyurethane, described as smooth-coated webbing and sold as Rubber Duc™ webbing.

Figure 2B:
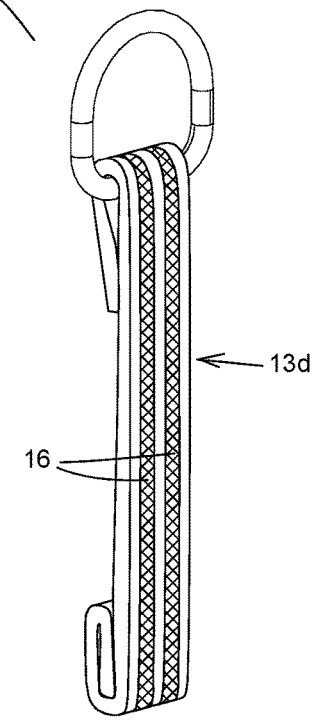
FIG. 2B illustrates a rear perspective view of another embodiment of a connector strap showing a backing layer comprising rubber material woven into the webbing's back surface.

As shown in a rear perspective view of FIG. 2B, other embodiments of connector strap 10 have slip-resistant webbing 13, where backing layer 16 is rubber (e.g., rubber strands) woven into back surface 13*d* as parallel strips extending along back surface 13*d*. One example of slip-resistant webbing 13 is polypropylene webbing with about 16% rubber by weight. Similar to the embodiment of FIG. 2, backing layer may also be applied to webbing 13 in parallel strips as shown in FIG. 2B.

In yet other embodiments, backing layer 16 is an adhesive applied to webbing 13. To protect the adhesive backing layer 16, a removable release sheet may be applied to backing layer 16 and removed prior to installation of connector strap 10. In yet other embodiments, backing layer 16 is a pressure-sensitive adhesive ("PSA") that forms a bond when pressure is applied.

Figure 3:
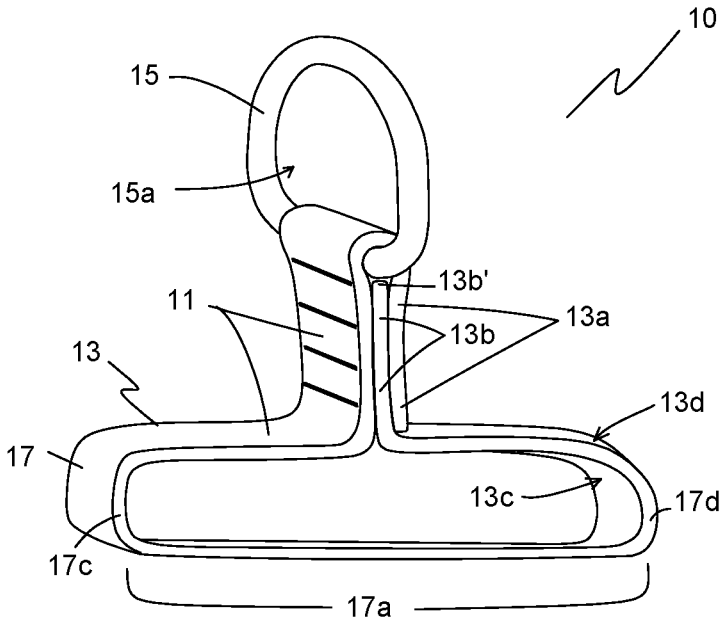
FIG. 3 illustrates a side perspective view of another embodiment of a connector strap of the present invention showing the first and second ends of the webbing secured to each other and defining a closed webbing loop.

Referring now to FIG. 3, a perspective view shows another embodiment of connector strap 10 secured to connector 15. In this embodiment, first end portion 13*a* of webbing 13 is looped through an opening 15*a* of connector 15 and secured (e.g., by stitching) to body portion 11, where second end portion 13*b* is sandwiched between first end portion 13*a* and body portion 11. In one embodiment, second end portion 13*b* extends in alignment with first end portion 13*a* and body portion 11, where second end 13*b*' is positioned closely adjacent connector 15. As shown in FIG. 3, by overlapping first end portion 13*a* and second portion 13*b* and then securing them to body portion 11, webbing 13 defines a closed webbing loop 17 with front surface 13*c* on the inside and back surface 13*d* on the outside. A portion 17*a* of closed webbing loop 17 may be positioned along an implement 5 to be tethered as is discussed in more detail below, where curves 17*c*, 17*d* along closed webbing loop 17 serve as first and second catches 12, 14, respectively. In some embodiments, second end portion 13*b* extends transversely (e.g., perpendicularly) to first end portion 13*a* and body portion 11, such as may be desired to create a twist in closed webbing loop 17.

Figure 4:
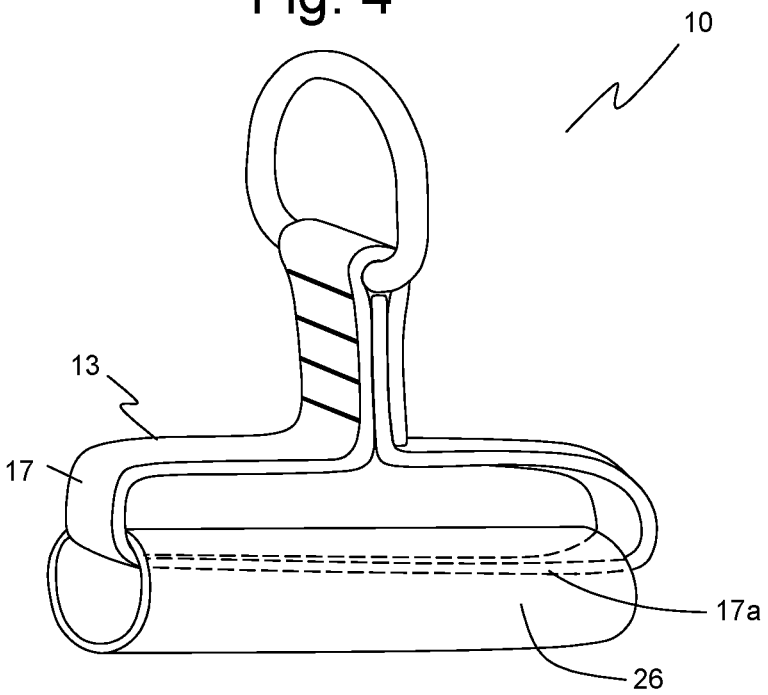
FIG. 4 illustrates a side perspective view of the connector strap of FIG. 3 shown with a length of shrink tubing installed over a portion of the closed webbing loop.

Referring now to FIG. 4, a perspective view illustrates another embodiment of connector strap 10. As in the embodiment of FIG. 3, webbing 13 defines a closed webbing loop 17. In this embodiment, portion 17*a* of closed webbing loop 17 extends through a length of shrink tubing 26 or other tubing made of an expandable material. Shrink tubing 26 may be, for example, heat shrink tubing, rubber tubing, or cold-shrink tubing supported in an expanded state, where shrink tubing 26 can change from an expanded size to a reduced size after being installed on implement 5. For example, during formation and assembly of closed webbing loop 17, webbing 13 is passed through shrink tubing 26 to link shrink tubing 26 to closed webbing loop 17. Shrink tubing 26 is used as an overwrap layer 23 as is discussed in more detail below.

In one embodiment, webbing 13 is stretchable. For example, webbing 13 is elastic webbing. In another embodiment, webbing 13 is a length of flat bungee cord having a rubber core and a jacket made of polypropylene or other materials. Examples of flat bungee cord are sold under the name Keeper® or Secure-Tite® (made by Hampton Products International of Foothill Ranch, Calif.) and CargoLoc® (made by Allied International of Sylmar, Calif.) and are sold in ¾-inch, one-inch, and other widths. Flat bungee cord stretches to a stretched length that is 150% or more of the length of the cord in its unstretched, relaxed state. In yet other embodiments, webbing is made of natural or synthetic rubber with a width of one-half inch to one inch.

Figure 5:
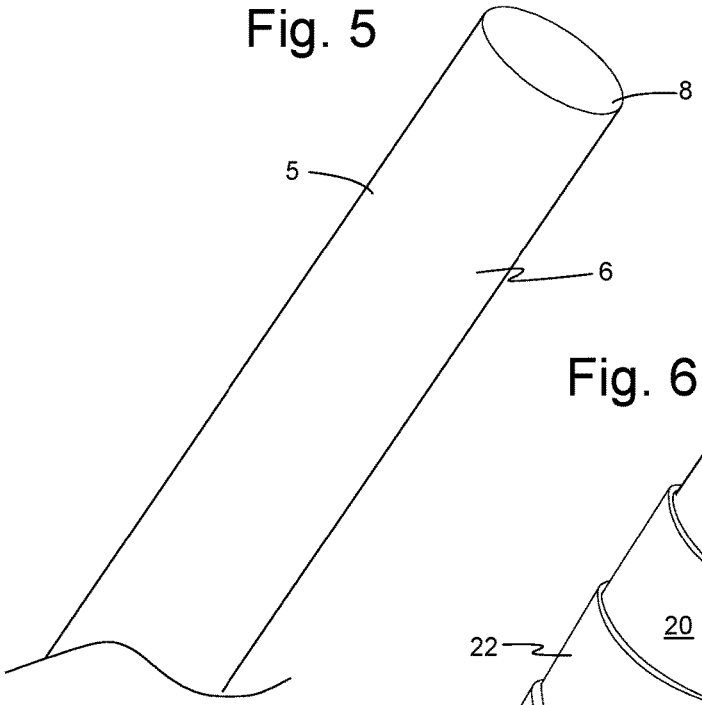
FIG. 5 illustrates a perspective view of a longitudinal end portion of an implement to be tethered, where the longitudinal end portion has a cylindrical shape and consistent cross-sectional size and geometry along its length.

Referring now to FIG. 5, a perspective view illustrates part of an exemplary embodiment of an implement 5 to be tethered. Implement 5 may be any hand tool having a portion 6 along which connector strap 10 may be positioned. Typically, portion 6 has a substantially consistent cross-sectional size along portion 6 to one end 8 of implement 5 and/or lacks any protruding feature or recess between portion 6 and end 8 that is greater in size than the cross-sectional size of portion 6 and that ordinarily could be used to maintain a tether on the implement 5. A hand tool such as, for example, mandrels, tubing tongs, valve wheel wrenches, spud wrenches, pipe wrenches, hammers, alignment bars and the like used in steel construction have posed a particular challenge since these tools often have a smooth, straight handle with a substantially consistent cross-section along the handle to a handle end 8, two working ends, or a handle that tapers as it extends to handle end 8. Such features render these tools particularly difficult for attaching and securely maintaining a tether connection on the tool for the purpose of preventing an accidental drop since they lack a protrusion or other feature that prevents a tether from slipping off of the tool end 8.

Figure 6:
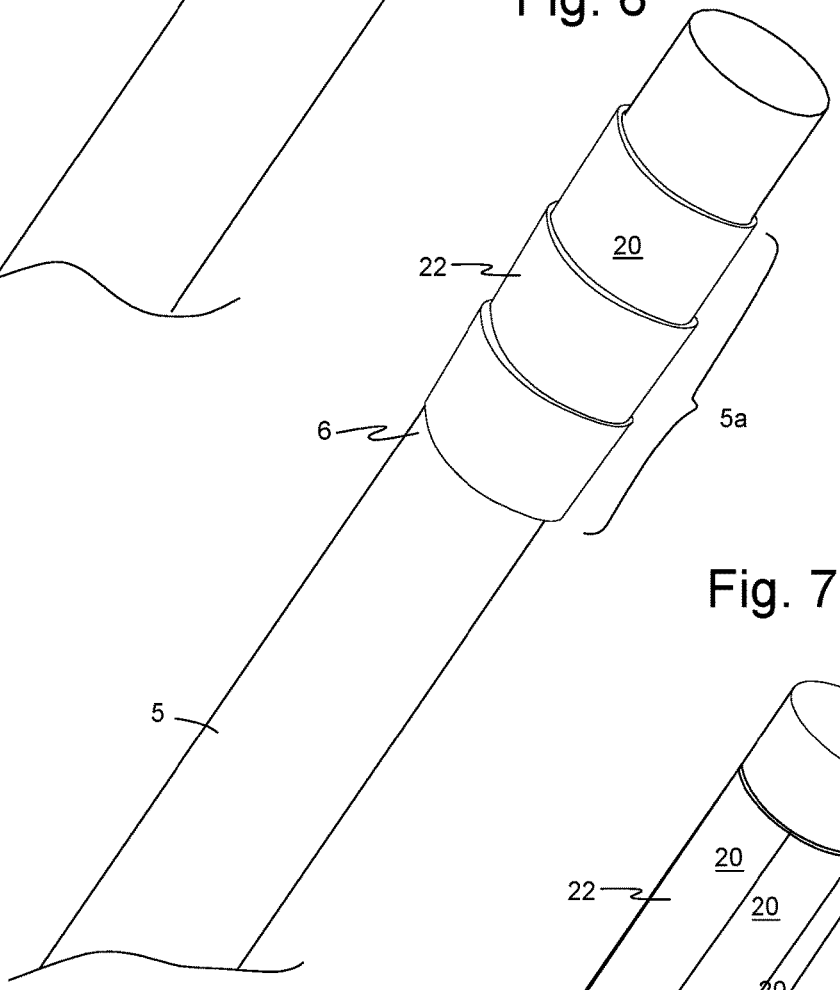
FIG. 6 illustrates a perspective view of the implement in FIG. 5 showing a base layer of a tape wrapped onto the end portion.
Figure 7:
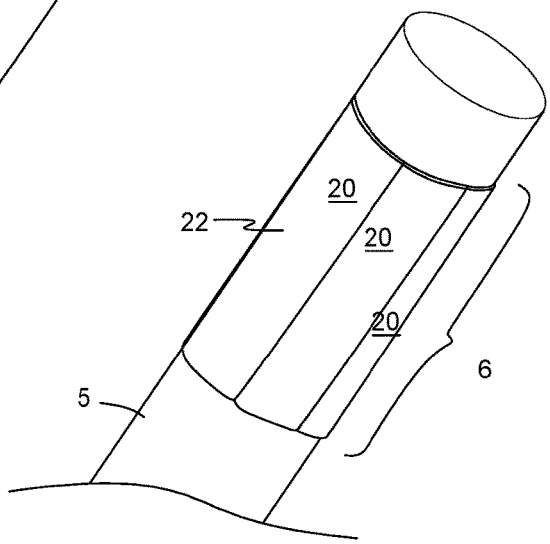
FIG. 7 illustrates a perspective view of the implement in FIG. 5 showing another embodiment of a base layer of tape applied around the cylindrical end portion, where a plurality of lengths of tape are placed axially along the cylindrical end portion and adjacent to each other circumferentially.

FIG. 6 illustrates a base layer 22 of tape 20 installed on a portion 6 of implement 5 by wrapping to provide a taped tool portion 5*a*. Taped tool portion 5*a* may be a handle, a longitudinal portion of implement 5, or another feature suitable in length for connector strap 10. In one embodiment, tape 20 is self-amalgamating or self-fusing tape made of silicone rubber, EPDM, ethylene propylene rubber (EPR), amalgamating butyl rubber, or polyisobutylene (PIB) amalgamating tape. One example of self-amalgamating tape is a mil spec reinforced silicone rubber tape meeting MIL-I-22444 specification as available, for example, from AB Thermal Technologies. The mil spec reinforced silicone rubber tape has a sinusoidal reinforcement fiberglass substrate for added strength and a tape width of about one inch. Other embodiments of self-amalgamating silicone rubber tape are non-reinforced. Another example of self-amalgamating tape is made by Arlon Silicone Technologies of Baer, Del., who makes a fully cured fusible silicone rubber tape with a 25% sinusoidal fiberglass substrate, a width of one inch, a thickness of about 1/32 inch, a tensile strength of 70 PSI, an elongation of 38%, a durometer of 50, an adhesion strength of 6 lb/inch, and meeting MIL-I-22444-C.

In other embodiments, tape 20 is any tape that increases the friction of taped tool region 5*a* compared to the bare surface of implement 5. Acceptable varieties of tape 20 include duct tape, vinyl adhesive tape, polyurethane cushioned grip tape, cloth tape with tacky surfaces (a.k.a. hockey tape), cloth tape as used for sports training and medicine, strapping tape, electrical tape, polymer handlebar tape (e.g., Lizard Skins™ bicycle handlebar tape) and the like. In one embodiment, applying tape 20 to implement 5 is performed by wrapping a continuous length of tape 20 in a spiral along a longitudinal portion 6 of implement 5. In some embodiments, each successive layer of tape 20 overlaps the previous layer by about 50% as it is wrapped in a spiral along implement 5. More or less overlap is acceptable. In other embodiments, individual lengths of tape 20 about equal in length to the circumference of portion 6 are wrapped circumferentially around implement 5 and positioned substantially parallel to one another and in close proximity, in axial abutment, or overlapping one another. In the embodiments where self-amalgamating or self-fusing tape is used, tape 20 is stretched during application onto implement 5, where stretching tape 20 activates the self-amalgamating properties of tape 20.

In one embodiment, taped tool portion 5*a* has a length approximately equal to or greater than the overall length 13L of connector strap 10 (or portion 17*a* of closed webbing loop 17). In another embodiment, taped tool portion 5*a* has a length at least as great as body portion 11 of connector strap 10 or at least as great as portion 17*a* of closed webbing loop 17. As an example, tape 20 is wrapped approximately 10-12 times around implement 5 in a single, overlapping spiral path to result in taped tool portion 5*a*, where a base layer 22 substantially has a single thickness of tape 20 except where edges overlap, where its thickness is doubled. In another example, tape 20 is wrapped around implement 5 in a plurality of overlapping spiral paths along the same region of implement 5, where taped tool portion 5*a* has base layer 22 with plurality of layers of tape 20. In yet another embodiment illustrated in FIG. 7, a plurality of lengths of tape 20 are oriented axially along implement 5 adjacent to each other. The lengths of tape 20 are generally parallel to one another along portion 6, where the plurality of lengths of tape 20 partially or completely cover portion 6 of implement 5. In one embodiment, lengths of tape 20 are applied axially along portion 6 of implement 5 in a region where connector strap 10 is to be positioned, but not along other regions of portion 6.

Figure 8:
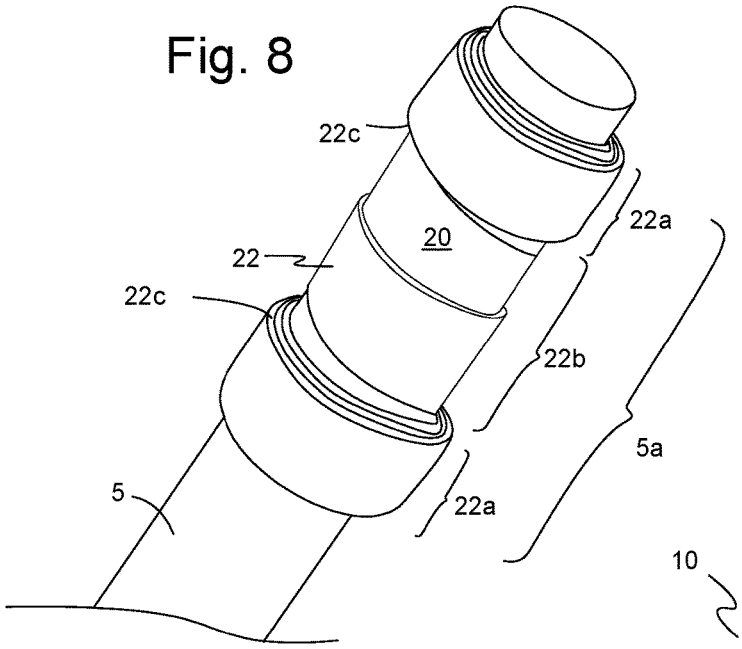
FIG. 8 illustrates a perspective of the implement of FIG. 5 showing a base layer installed with built-up regions formed with a plurality of overlapping tape layers.

Referring now to FIG. 8, another embodiment of base layer 22 is shown applied to implement 5 "with geometry." Where implement 5 lacks a protruding feature or recess with which connector strap 10 may engage, base layer 22 optionally includes one or more built-up regions 22*a* that protrude from implement 5 to a greater extent than a middle region 22*b* of base layer 22. For example, each built-up region 22*a* is formed by four overlapping and substantially aligned layers of tape 20, where built-up region 22*a* defines a shoulder 22*c*. Tape 20 then extends from built-up region 22*a* or starts anew as an overlapping spiral extending along middle region 22*b*. Built-up region 22*b* and middle region 22*b* define a circuitous or non-linear path axially along taped tool region 5*a* of built-up region(s) 22*a* and middle region(s) 22*b*. By creating geometry with one or more built-up region(s) 22*a*, connector strap 10 extends along the non-linear path when aligned along taped tool region 5*a* and encounters further resistance against shoulder(s) 22*c* when a force is applied to connector strap 10 in an axial direction since connector strap 10 substantially takes the shape of the non-linear path. Thus, shoulder(s) 22*c* increase frictional engagement between connector strap 10 and base layer 22 and further reduce the ability of connector strap 10 being pulled axially along implement 5.

Figure 9:
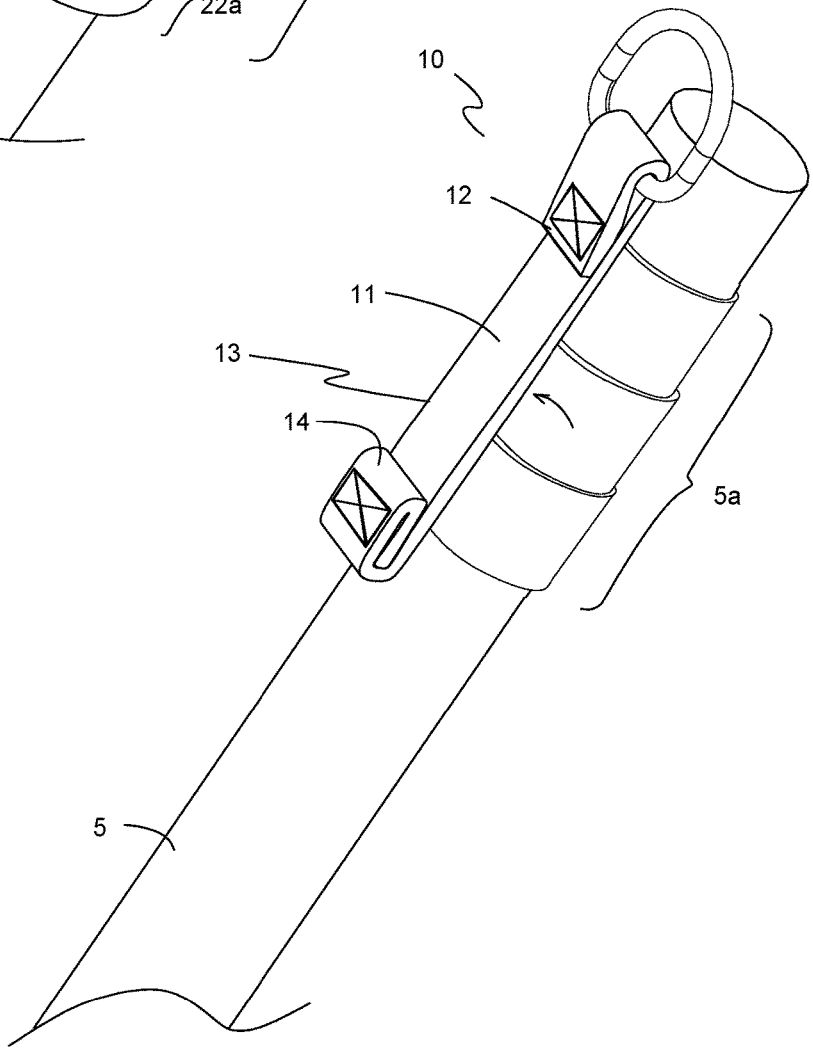
FIG. 9 illustrates a perspective view of the implement in FIG. 6 showing one embodiment of a connector strap positioned with its back surface in contact with the base layer.

Referring now to FIG. 9, an embodiment of connector strap 10 is aligned with taped tool portion 5*a* and positioned with back surface 13*d* (not visible) in contact with base layer 22. Similarly, portion 17*a* of closed webbing loop 17 (shown in FIG. 3) may be positioned against taped tool portion 5*a*. Optionally, when base layer 22 is not present, connector strap 10 is positioned in direct contact with portion 6 of implement 5. In one embodiment, connector strap 10 is oriented axially along taped tool region 5*a*. Body portion 11 of connector strap 10 is aligned with taped tool region 5*a* of implement 5, where first catch 12 and second catch 14 face outwardly away from implement 5 to engage an overwrap layer 23. Doing so provides additional assurance that connector strap 10 will not be pulled between overwrap layer 23 and base layer 22.

Figure 10:
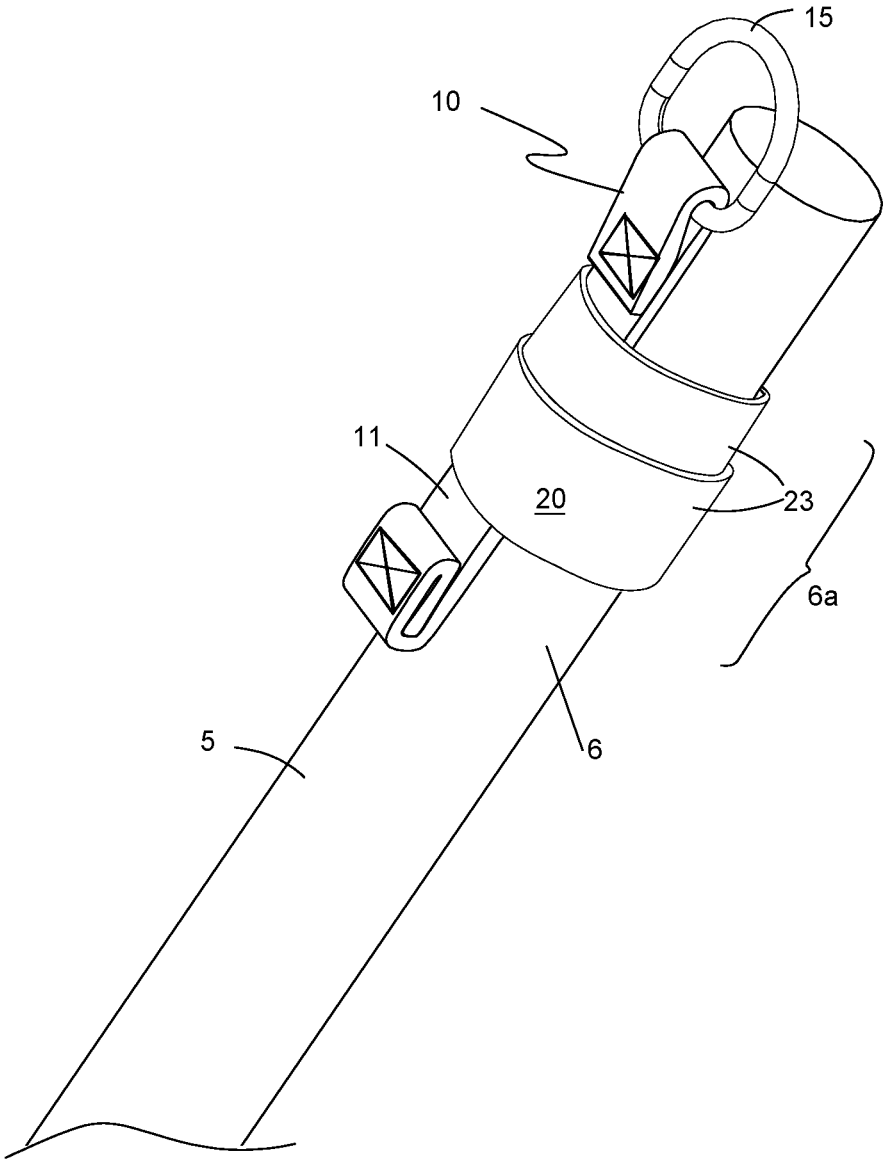
FIG. 10 illustrates a perspective view of the connector strap of FIG. 1 axially aligned on the implement with an overwrap member installed over the body portion of the connector strap and corresponding longitudinal portion of the implement.

Turning now to FIG. 10, a perspective view shows an embodiment of connector strap 10 aligned with implement 5 with back surface 13*d* in direct contact with implement 5. In embodiments where connector strap 10 includes backing layer 16, base layer 22 is optional. Thus, connector strap 10 is positioned with back surface 13*d* (i.e., backing layer 16, shown in FIGS. 2A-2B) in direct contact with portion 6 of implement 5. An overwrap layer 23 is installed over body portion 11 of connector strap 10 and longitudinal portion 6 of implement 5 to secure connector strap 10 to implement 5.

Overwrap layer 23 is installed in one embodiment by wrapping tape 20 around body portion 11 of connector strap 10 (or portion 17*a* of closed webbing loop 17) and the corresponding region 6*a* of longitudinal portion 6 of implement 5. For example, when body portion 11 is about three inches in length, overwrap layer 23 may be about six to ten overlapping layers of tape 20, depending on the width of tape 20. In other embodiments, such as when connector strap 10 defines closed webbing loop 17 and includes shrink tubing 26, shrink tubing 26 is overwrap layer 23 where portion 17*a* of closed webbing loop 17 passes through shrink tubing 26.

Figure 11:
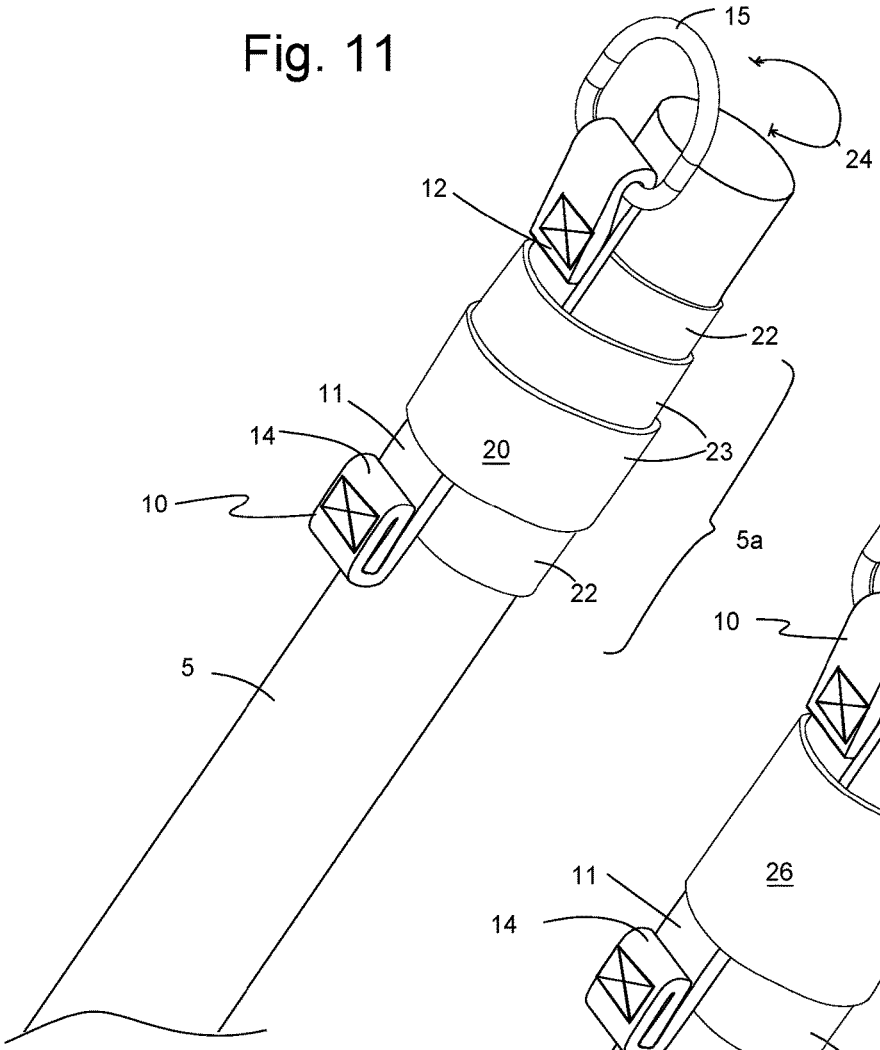
FIG. 11 illustrates a perspective view of the implement in FIG. 6 showing a connector strap positioned against the base layer and an overwrap member wrapped around the connector strap and corresponding portion of the implement and base layer.

Referring now to FIG. 11, overwrap layer 23 in one embodiment is tape 20 wrapped around body portion 11 of connector strap 10 and the corresponding portion of taped tool portion 5*a*. In one embodiment, overwrap layer 23 is formed by wrapping tape 20 over body portion 11 of connector strap 10 and taped tool portion 5*a*, where overwrap layer 23 overlaps and contacts base layer 22 along a major circumferential portion 24 (i.e., at least 180° around base layer 22). In one embodiment, overwrap layer 23 includes tape 20 wrapped in a spiral path having at least two overlapping revolutions around body portion 11 and taped tool portion 5*a*. In another embodiment, tape 20 is wrapped in a plurality of overlapping spiral paths back and forth across body portion 11, where overwrap layer 23 has at least two overlapping spiral layers of tape 20 along body portion 11. Optionally, overwrap layer 23 extends over first catch 12 of connector strap 10. In some embodiments, as with base layer 22, overwrap layer 23 is installed "with geometry," where overwrap layer has one or more built-up regions 23*b* (shown, e.g., in FIGS. 25-27).

Figure 12:
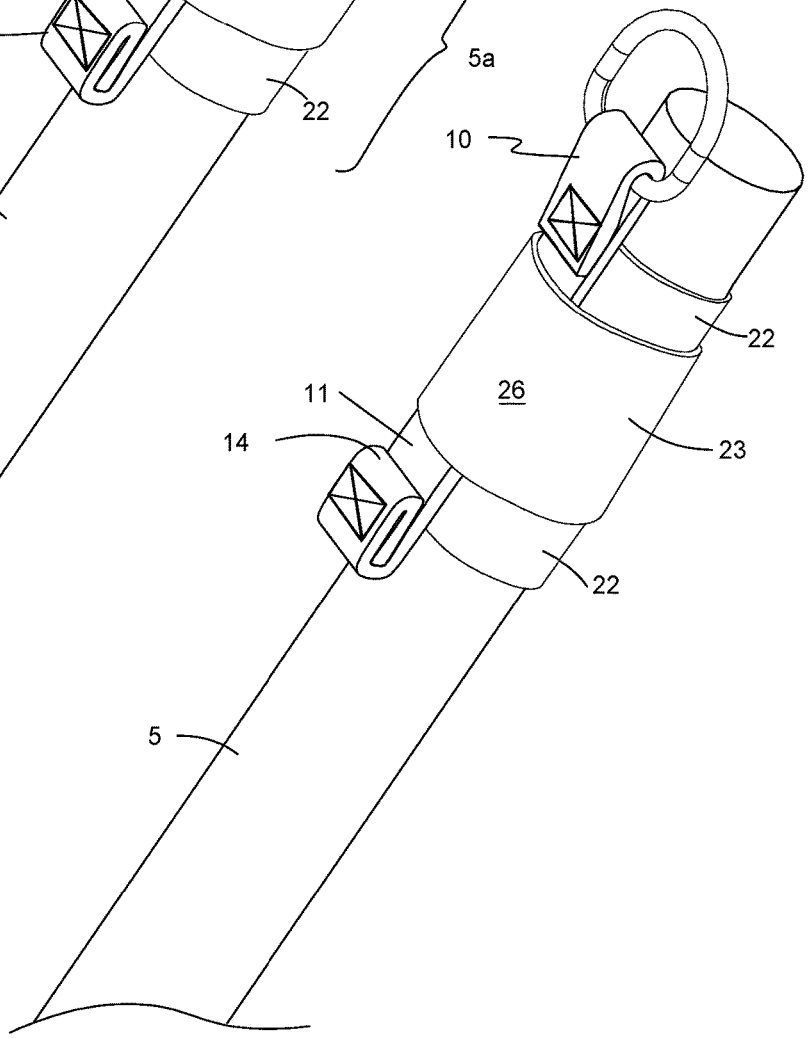
FIG. 12 illustrates a perspective view of the implement in FIG. 6 showing a connector strap positioned against the base layer and another embodiment of an overwrap member installed over the connector strap and corresponding portion of the implement and base layer where the overwrap member is shrink tubing.

In another embodiment shown in FIG. 12, overwrap layer 23 is a length of shrink tubing 26 installed over body portion 11 of connector strap and taped tool portion 5*a*. Shrink tubing 26 may be heat-shrink tubing, cold-shrink tubing, rubber tubing, or the like and made of materials such as EPDM rubber, neoprene, synthetic rubber and fluoropolymer elastomers known as Viton®, or other materials known in the art for shrink tubing. When overwrap layer 23 is cold shrink tubing, the user provides cold shrink tubing supported in a radially stretched condition on an easily removable rigid spiral hollow core (not shown) having interconnected adjacent coils as is known in the art. After placing taped tool portion 5*a* (or portion 6) of implement 5 into the hollow core and aligning shrink tubing 26 with body portion 11 of connector strap 10, the user then applies heat to shrink tubing in the case of a heat shrink tubing or uncoils the spiral hollow core to remove the core as a continuous narrow strip in the case of a cold shrink tubing. In either case, shrink tubing 26 collapses on and tightens around body portion 11 and taped tool portion 5*a* (or portion 6). In one embodiment, care is taken to avoid overlapping second catch 14 with shrink tubing overwrap layer 23. Doing so enables second catch 14 to perform its function of engaging overwrap layer 23 to restrict connector strap 10 from passing under overwrap layer 23. Accordingly, second catch 14 prevents connector strap 10 from being pulled loose through overwrap layer 23. In some embodiments where overwrap layer 23 is tape 20, shrink tubing 26 is applied over tape 20 of overwrap layer 23 as an additional overwrap layer 23*a* (shown, e.g., in FIG. 16).

In embodiments where a self-amalgamating or self-fusing tape is used for base layer 22 and/or overwrap layer(s) 23, the user typically waits at least 24 hours for base layer 22 and overwrap layer 23 to fuse to itself and to each other before using implement 5.

The methods of the present invention substantially improve the capacity of connector strap 10 from tearing or being pulled off of implement 5. Methods of attaching connector strap 10 to implement 5 discussed herein have shown to have increased strength compared with prior art methods of attaching connector strap 10 to implement 5. This increased strength is believed to be a result of overwrap layer 23 fusing with base layer 22, adhering to base layer 22, and/or having increased friction between base layer 22 and overwrap layer 23 compared to the friction between overwrap layer 23 and the bare surface of implement 5. When overwrap layer 23 fuses or adheres to base layer 22, the strength of overwrap layer 23 is increased to resist failure of the tethering method when connector strap 10 is subjected to pulling forces transverse to the central longitudinal axis of implement 5. Frictional and/or adhesive forces between base layer 22 and overwrap layer 23 resist failure of the tethering method when connector strap 10 is subjected to pulling forces along or parallel to the central longitudinal axis of implement 5. In embodiments where connector strap 10 includes backing layer 16, the frictional engagement between backing layer 16 and implement 5 is believed to complement the strength of overwrap layer 23 to provide a connector strap 10 secured to implement 5 in a way that sustains larger forces before failure occurs.

Figure 13:
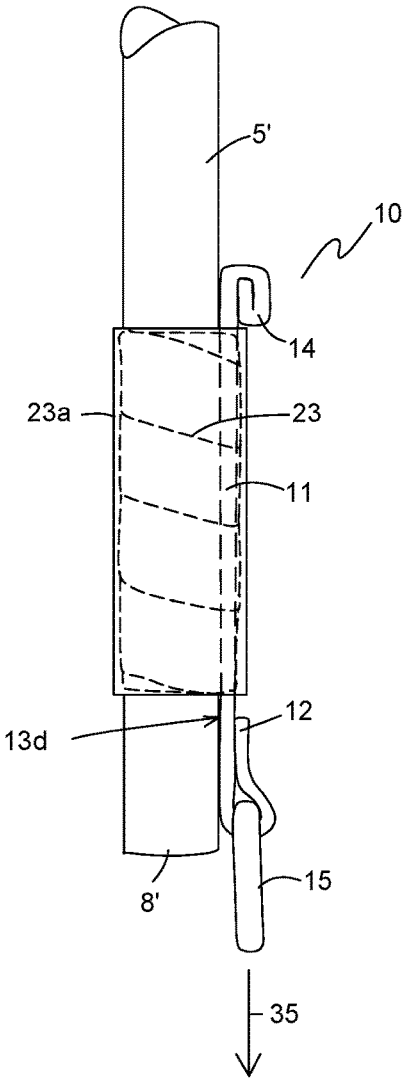
FIG. 13 illustrates test configuration 1 for one embodiment of a connector strap installed on an implement in a vertical position with the connector positioned towards the end of the implement.
Figure 14:
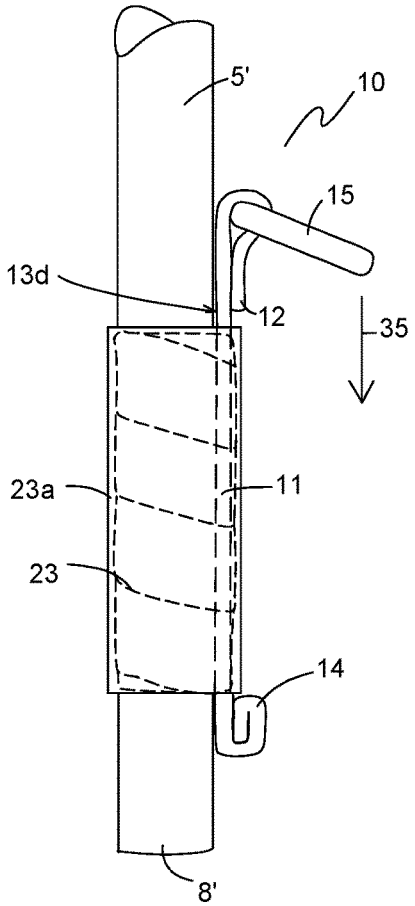
FIG. 14 illustrates test configuration 2 for one embodiment of a connector strap installed on an implement in a vertical position with the connector positioned away from the end of the implement.
Figure 15:
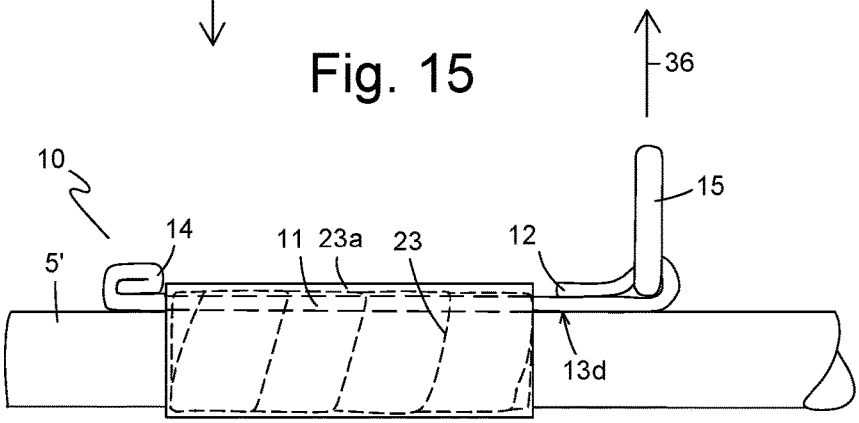
FIG. 15 illustrates test configuration 3 for one embodiment of a connector strap installed on an implement maintained in a horizontal position.

Using methods of the present invention, experiments conducted at room temperature and 50% relative humidity have shown the increased strength of tethering methods of the present invention. In these experiments, connector strap 10 was attached using various test configurations to a cylindrical steel mandrel 5' with an outer diameter of 1.05 inch. A load was attached to connector 15 and then the assembly was subjected to tensile forces in an axial direction or in a direction perpendicular to the axis of the mandrel. The experimental setups and results of the experiments are discussed below with reference to FIGS. 13-29. FIGS. 13-15 illustrate three test configurations as used for reference measurements. FIGS. 16-29 illustrate variations on the three test configurations using tethering methods of the present invention.

FIG. 13 illustrates test configuration 1. Test configuration 1 has connector strap 10 aligned axially with a cylindrical steel mandrel 5'. In this test configuration 1, cylindrical steel mandrel 5' has a diameter of about one inch. Connector 15 is positioned towards end 8' of mandrel 5'. For a reference measurement, no base layer 22 is used and back surface 13*d* is placed in direct contact with the surface of mandrel 5'. A first overwrap layer 23 of non-reinforced self-amalgamating silicone tape is applied in a single overlapping spiral along body portion 11 and mandrel 5' from a position adjacent first catch 12 to a position adjacent second catch 14. Each wrap of the tape overlaps the previous wrap by about 50%. A second overwrap layer 23*a* is shrink tubing installed over overwrap layer 23 and the corresponding portion of body portion 11 and mandrel 5'. As part of the installation, the shrink tubing is heated to cause it to shrink and conform to connector strap 10 with first overwrap layer 23 and mandrel 5'. Connector strap 10 is configured as shown in FIG. 1 with first and second catches 12, 14, a metal D-ring connector 15, and webbing 13 made of woven nylon without backing layer 16. A tensile force connected to connector 15 is applied axially downward as shown by arrow 35 at three inches per minute using a calibrated Chatillon LR30K materials testing machine. Attachment of connector strap 10 to mandrel 5' failed at 80 lbs. of force as noted by connector strap 10 with overwrap layers 23, 23*a* sliding downward along mandrel 5'.

FIG. 14 illustrates test configuration 2 in which connector strap 10 is aligned axially with mandrel 5' with connector 15 positioned away from end 8' of mandrel 5'. For a reference measurement using test configuration 2, no base layer 22 is used and connector strap is attached to mandrel 5' with back surface 13*d* in direct contact with the surface of mandrel 5'. Overwrap layer 23 and second overwrap layer 23*a* are the same as in test configuration 1. A tensile force connected to connector 15 was applied axially downward as shown by arrow 35 at three inches per minute using the calibrated Chatillon LR30K materials testing machine. Attachment of connector strap 10 to mandrel 5' in test configuration 2 failed at 122 lbs. of force as noted by connector strap 10 with overwrap layers 23, 23*a* sliding downward along mandrel 5'.

FIG. 15 illustrates test configuration 3 in which connector strap 10 is aligned axially with mandrel 5' and positioned for a force transverse to mandrel 5'. For a reference measurement using test configuration 3, no base layer 22 is used and connector strap 10 is attached to mandrel 5' with back surface 13*d* in direct contact with the surface of mandrel 5'. Overwrap layer 23 and second overwrap layer 23*a* are applied as in test configuration 1. Mandrel 5' is maintained in a horizontal position and then a tensile force connected to connector 15 was applied upward from connector 15 in a direction substantially perpendicular to mandrel 5' as shown by arrow 36 at three inches per minute using the calibrated Chatillon LR30K materials testing machine. Attachment of connector strap 10 to mandrel 5' in test configuration 3 failed at 427 lbs. of force as noted by connector strap 10 being pulled between overwrap layer 23 and second overwrap layer 23*a*.

Reference measurements using test configurations 1-3 as illustrated in FIGS. 13-15 (without base layer 22) are representative of tethering methods of the prior art. The results of the reference measurements for test configurations 1-3 of FIGS. 13-15, respectively, are summarized in Table 1 below.

TABLE 1

Reference measurements for tethering methods shown in FIGS. 13-15.

| Configuration | Base Layer | Overwrap layer | Second overwrap layer | Failure force (lbs) |
|---|---|---|---|---|
| Test configuration 1 | None | Non-reinforced self-amalgamating silicone tape | Shrink tubing | 80 |
| Test configuration 2 | None | Non-reinforced self-amalgamating silicone tape | Shrink tubing | 122 |
| Test configuration 3 | None | Non-reinforced self-amalgamating silicone tape | Shrink tubing | 427 |

Figure 16:
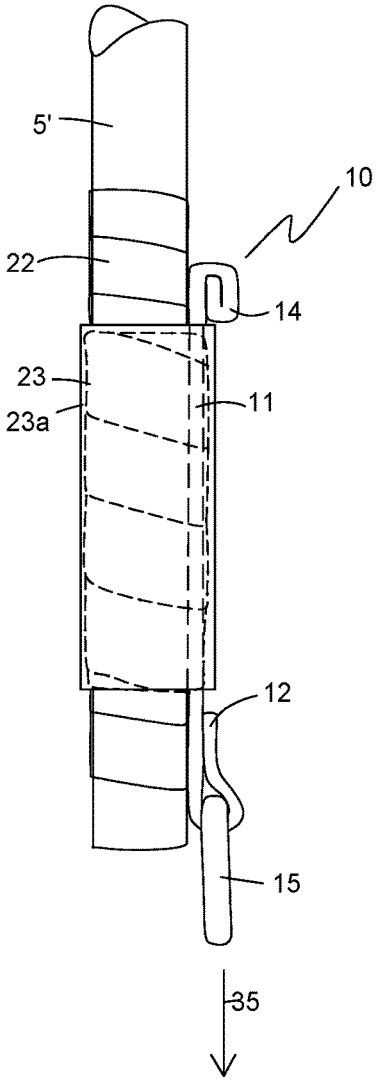
FIG. 16 illustrates test configuration 1 for a connector strap installed on an implement using a base layer, overwrap layer, and a second overwrap layer.

Referring now to FIG. 16, connector strap 10 is secured to mandrel 5' as in test configuration 1. For this measurement, base layer 22 is installed along the longitudinal portion of mandrel 5'. Thus, instead of back surface 13*d* being in direct contact with the surface of mandrel 5', back surface 13*d* is in direct contact with base layer 22. Base layer 22 is non-reinforced self-amalgamating silicone tape wrapped in a single spiral around mandrel 5' using a 50% overlap between successive wraps of tape. As with the reference measurement discussed above, a tensile force connected to connector 15 was applied axially downward as shown by arrow 35 at three inches per minute using the calibrated Chatillon LR30K materials testing machine. Attachment of connector strap 10 to mandrel 5' in test configuration 1 failed at 263 lbs. of force as noted by connector strap 10 with overwrap layers 23, 23*a* sliding downward along base layer 22.

Figure 17:
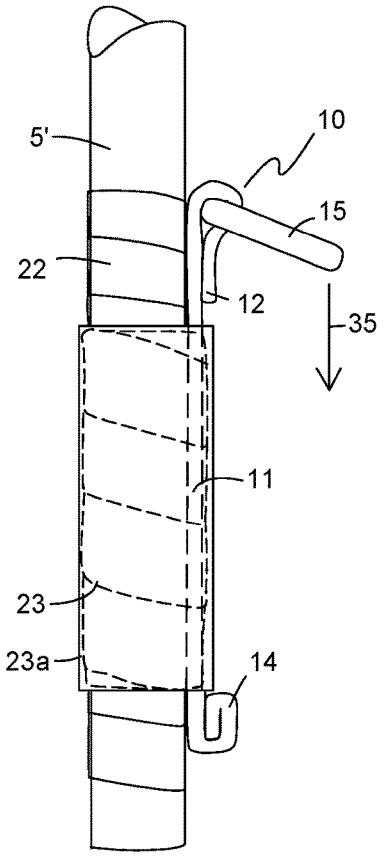
FIG. 17 illustrates test configuration 2 for a connector strap installed on an implement using a base layer, overwrap layer, and a second overwrap layer.

Referring now to FIG. 17, connector strap 10 is secured to mandrel 5' as in test configuration 2. For this measurement, base layer 22 is installed along the longitudinal portion of mandrel 5'. Thus, instead of back surface 13*d* being in direct contact with the surface of mandrel 5', back surface 13*d* is in direct contact with base layer 22. Base layer 22 is non-reinforced self-amalgamating silicone tape wrapped in a single spiral around mandrel 5' using a 50% overlap between successive wraps of the tape. As with test configuration 1, a first overwrap layer 23 (not visible) of non-reinforced self-amalgamating silicone tape 20 was applied in a single overlapping spiral along body portion 11 and mandrel 5 from first catch 12 to second catch 14, where each wrap of the tape overlaps the previous wrap by about 50%. Second overwrap layer 23*a* is heat shrink tubing 26 is applied over overwrap layer 23 and the corresponding portion of body portion 11 between first and second catches 12, 14, base layer 22, and mandrel 5'. A tensile force connected to connector 15 is applied axially downward as shown by arrow 35 at three inches per minute using the calibrated Chatillon LR30K materials testing machine. Attachment of connector strap 10 to mandrel 5' in test configuration 2 failed at 231 lbs. of force as noted by connector strap 10 with overwrap layers 23, 23*a* sliding downward along base layer 22.

Figure 18:
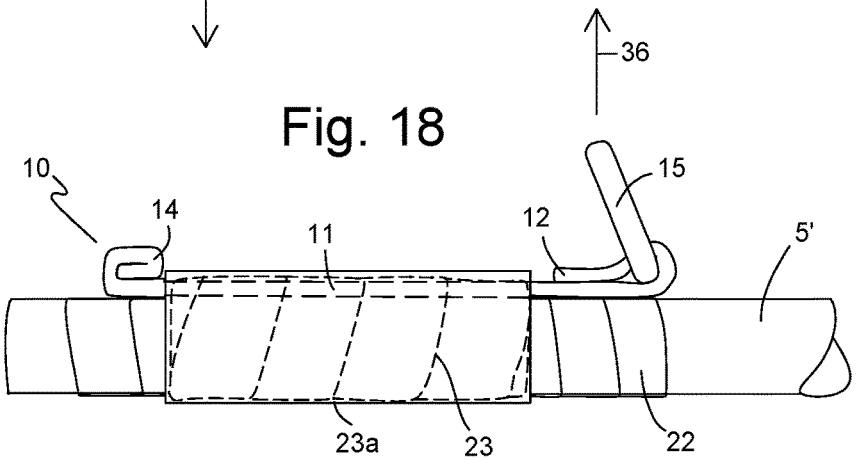
FIG. 18 illustrates test configuration 3 for a connector strap installed on an implement using a base layer, overwrap layer, and a second overwrap layer.

Referring now to FIG. 18, connector strap 10 is secured to mandrel 5' as in test configuration 3, where connector strap is positioned for a force applied substantially perpendicularly to mandrel 5'. For this measurement, base layer 22 is installed along the longitudinal portion of mandrel 5'. Thus, back surface 13*d* is in direct contact with base layer 22. Base layer 22 is non-reinforced self-amalgamating silicone tape wrapped in a single spiral around mandrel 5' using a 50% overlap between successive wraps of the tape. First overwrap layer 23 (not visible) of non-reinforced self-amalgamating silicone tape is applied in a single overlapping spiral along body portion 11 and mandrel 5 from first catch 12 to second catch 14, where each wrap of the tape overlaps the previous wrap by about 50%. Second overwrap layer 23*a* is heat shrink tubing 26 installed over overwrap layer 23 and the corresponding body portion 11, base layer 22, and mandrel 5'. Mandrel 5' is held in a horizontal position and a tensile force connected to connector 15 is applied upward from connector 15 in a direction substantially perpendicular to mandrel 5' as shown by arrow 36 at three inches per minute using the calibrated Chatillon LR30K materials testing machine. Attachment of connector strap 10 to mandrel 5' in test configuration 3 failed at 429 lbs. of force as noted by connector strap 10 pulling through overwrap layer 23 and second overwrap layer 23*a*.

Test configurations 1-3 of FIGS. 16-18, respectively, are summarized in Table 2 below. Compared to reference measurements of FIGS. 13-15 discussed above, test configuration 1 of FIG. 16 increased from 80 lbs to 263 lbs; test configuration 2 of FIG. 17 increased from 122 lbs to 231 lbs, and test configuration 3 of FIG. 18 increased slightly from 427 lbs to 429 lbs.

TABLE 2 measurements for tethering methods shown in FIGS. 16-18.

| Configuration | Base Layer | Overwrap layer | Second overwrap layer | Failure force (lbs) |
|---|---|---|---|---|
| Test configuration 1 | Non-reinforced self-amalgamating silicone tape | Non-reinforced self-amalgamating silicone tape | Shrink tubing | 263 |
| Test configuration 2 | Non-reinforced self-amalgamating silicone tape | Non-reinforced self-amalgamating silicone tape | Shrink tubing | 231 |
| Test configuration 3 | Non-reinforced self-amalgamating silicone tape | Non-reinforced self-amalgamating silicone tape | Shrink tubing | 429 |

Figure 19:
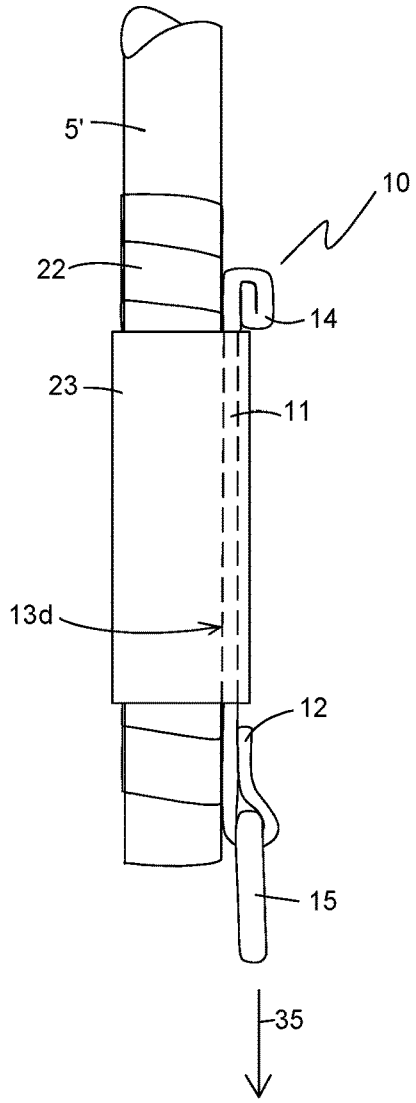
FIG. 19 illustrates test configuration 1 for a connector strap installed on an implement using a base layer of tape and overwrap layer of shrink tubing.
Figure 20:
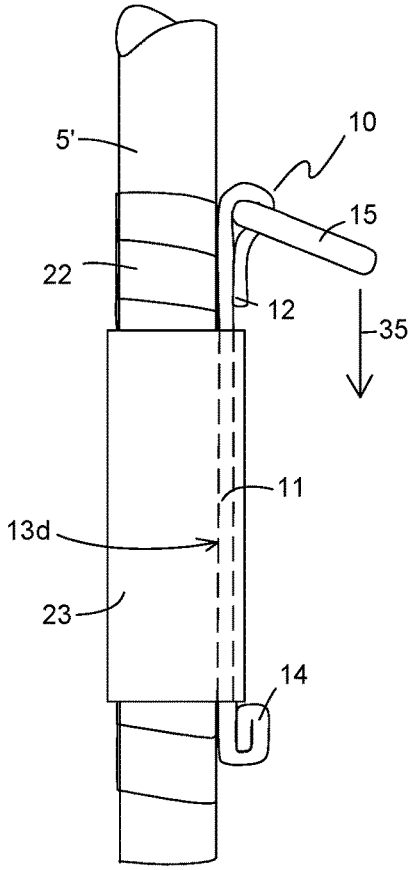
FIG. 20 illustrates test configuration 2 for the connector strap installed on an implement using a base layer of tape and overwrap layer of shrink tubing.
Figure 21:
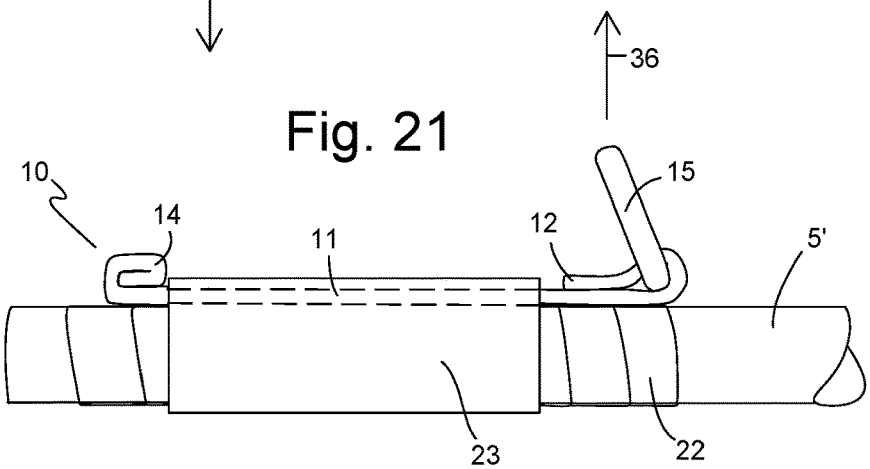
FIG. 21 illustrates test configuration 3 for the connector strap installed on an implement using a base layer of tape and overwrap layer of shrink tubing.

Referring now to FIGS. 19-21, test configurations 1-3 are repeated as above with additional variations in base layer 22, overwrap layer 23, and second overwrap layer 23*a* as noted. Base layer 22 is non-reinforced self-amalgamating silicone tape wrapped in a single spiral around mandrel 5' using a 50% overlap between successive wraps of the tape. Connector strap 10 is positioned with back surface 13*d* in direct contact with base layer 22. Overwrap layer 23 is heat shrink tubing installed over body portion 11 between first and second catches 12, 14. Tensile forces connected to connector 15 are applied as discussed above for reference measurements of FIGS. 13-15, respectively. As setup here, test configuration 1 (FIG. 19) failed at 128 lbs., test configuration 2 (FIG. 20) failed at 143 lbs., and test configuration 3 (FIG. 21) failed at 264 lbs.

Test configurations of FIGS. 19-21 are summarized in Table 3 below. Compared to reference measurements of FIGS. 13-15 discussed above, test configuration 1 of FIG. 19 increased from 80 lbs. to 128 lbs.; test configuration 2 of FIG. 20 increased from 122 lbs. to 143 lbs., and test configuration 3 of FIG. 15 decreased from 427 lbs. to 264 lbs. The decrease in failure force for test configuration 3 is likely due to the difference in materials for the overwrap layer 23 and that the tests of FIG. 21 did not have a second overwrap layer as was the case for FIG. 15.

TABLE 3 measurements for tethering methods shown in FIGS. 19-21.

| Configuration | Base Layer | Overwrap layer | Second overwrap layer | Failure force (lbs) |
|---|---|---|---|---|
| Test configuration 1 | Non-reinforced self-amalgamating silicone tape | Shrink tubing | None | 128 |
| Test configuration 2 | Non-reinforced self-amalgamating silicone tape | Shrink tubing | None | 143 |
| Test configuration 3 | Non-reinforced self-amalgamating silicone tape | Shrink tubing | None | 264 |

Figure 22:
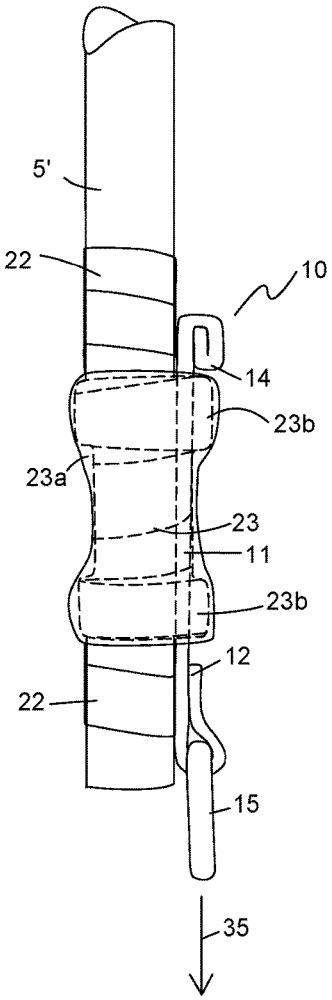
FIG. 22 illustrates test configuration 1 for a connector strap installed on an implement using a base layer of tape, an overwrap layer with geometry, and a second overwrap layer of shrink tubing.
Figure 23:
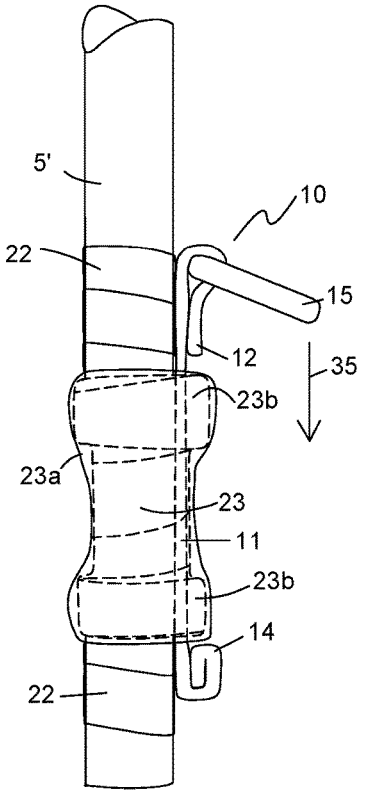
FIG. 23 illustrates test configuration 2 for the connector strap installed on an implement using a base layer of tape, an overwrap layer with geometry, and a second overwrap layer of shrink tubing.
Figure 24:
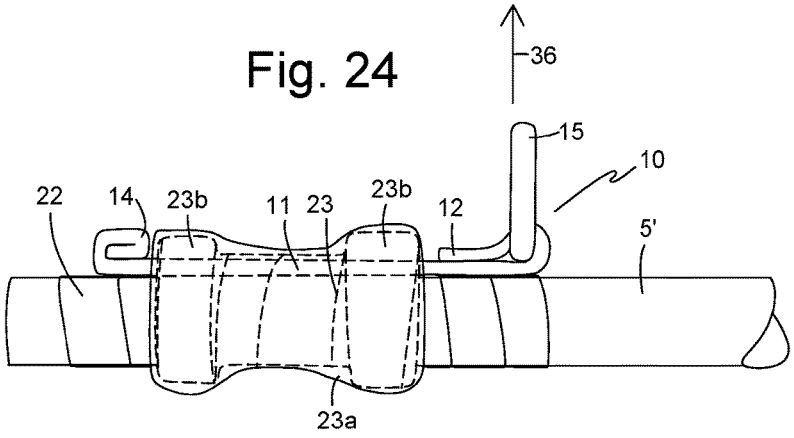
FIG. 24 illustrates test configuration 3 for the connector strap installed on an implement using a base layer of tape, an overwrap layer with geometry, and a second overwrap layer of shrink tubing.

Referring now to FIGS. 22-24, test configurations 1-3 are repeated as above with additional variations in base layer 22, overwrap layer 23, and second overwrap layer 23*a* as noted. Base layer 22 is non-reinforced or reinforced self-amalgamating silicone tape wrapped in a single spiral around mandrel 5' using a 50% overlap between successive wraps of the tape. Connector strap 10 is positioned with back surface 13*d* in direct contact with base layer 22. Overwrap layer 23 is either non-reinforced or reinforced self-amalgamating tape wrapped with geometry. That is, overwrap layer 23 is wrapped with four 100% overlapping revolutions resulting in built-up region 22*a* adjacent first catch 12, then in a spiral with 50% overlap towards second catch 14, then wrapped four 100% overlapping revolutions that result in another built-up region 22*a* adjacent second catch 14. Second overwrap layer 23*a* is heat shrink tubing applied over overwrap layer 23 and body portion 11 between first and second catches 12, 14. Tensile forces connected to connector 15 are applied as discussed above for reference measurements of FIGS. 13-15, respectively.

Test configurations of FIGS. 22-24 are summarized in Table 4 below. Compared to reference measurements of FIGS. 13-15 discussed above, test configuration 1 of FIG. 22 increased from 80 lbs. to 140 lbs. or 263 lbs.; test configuration 2 of FIG. 23 increased from 122 lbs. to 192 lbs. or 231 lbs., and test configuration 3 of FIG. 24 decreased from 427 lbs. to 384 lbs. or increased slightly to 429 lbs.

TABLE 4 measurements for tethering methods shown in FIGS. 22-24.

| Configuration | Base Layer | Overwrap layer | Second overwrap layer | Failure force (lbs) |
|---|---|---|---|---|
| Test configuration 1 | Reinforced self-amalgamating silicone tape | Reinforced self-amalgamating silicone tape with geometry | Shrink tubing | 140 |
| Test configuration 1 | Non-reinforced self-amalgamating silicone tape | Reinforced self-amalgamating silicone tape with geometry | Shrink tubing | 263 |

TABLE 4-continued measurements for tethering methods shown in FIGS. 22-24.

| Configuration | Base Layer | Overwrap layer | Second overwrap layer | Failure force (lbs) |
|---|---|---|---|---|
| Test configuration 1 | Non-reinforced self-amalgamating silicone tape | Non-reinforced self-amalgamating silicone tape with geometry | Shrink tubing | 218 |
| Test configuration 2 | Reinforced self-amalgamating silicone tape | Reinforced self-amalgamating silicone tape with geometry | Shrink tubing | 192 |
| Test configuration 2 | Non-reinforced self-amalgamating silicone tape | Reinforced self-amalgamating silicone tape with geometry | Shrink tubing | 231 |
| Test configuration 2 | Non-reinforced self-amalgamating silicone tape | Non-reinforced self-amalgamating silicone tape with geometry | Shrink tubing | 231 |
| Test configuration 3 | Reinforced self-amalgamating silicone tape | Reinforced self-amalgamating silicone tape with geometry | Shrink tubing | 384 |
| Test configuration 3 | Non-reinforced self-amalgamating silicone tape | Reinforced self-amalgamating silicone tape with geometry | Shrink tubing | 429 |
| Test configuration 3 | Non-reinforced self-amalgamating silicone tape | Non-reinforced self-amalgamating silicone tape with geometry | Shrink tubing | 288 |

Figure 25:
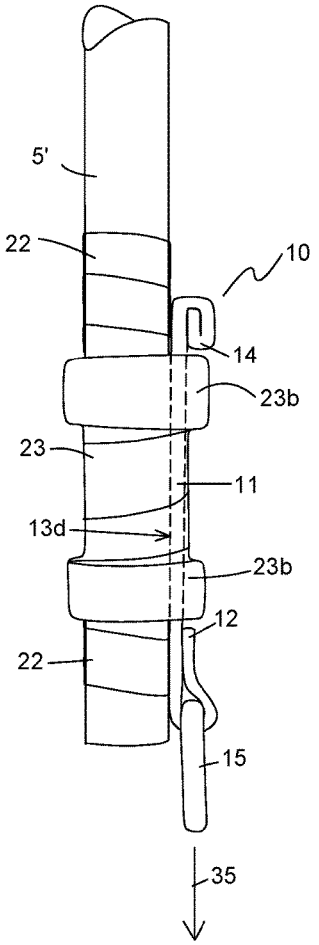
FIG. 25 illustrates test configuration 1 for a connector strap installed on an implement using a base layer of tape and an overwrap layer with geometry.
Figure 26:
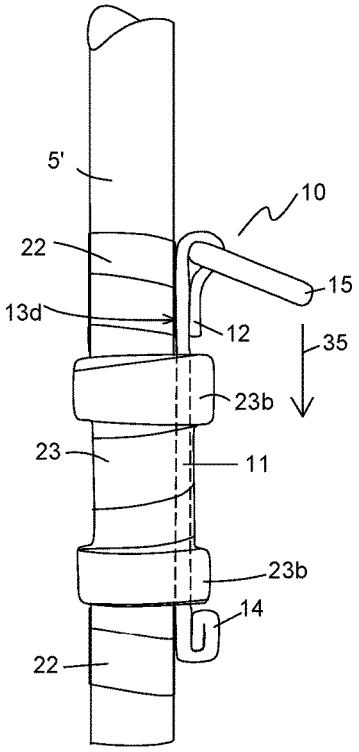
FIG. 26 illustrates test configuration 2 for the connector strap installed on an implement using a base layer of tape and an overwrap layer with geometry.
Figure 27:
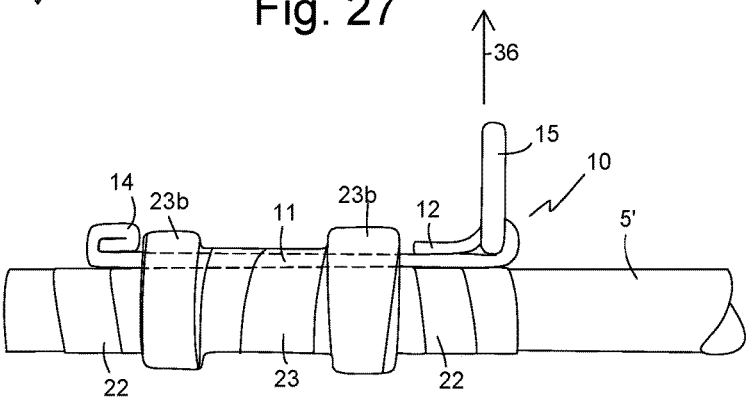
FIG. 27 illustrates test configuration 3 for the connector strap installed on an implement using a base layer of tape and an overwrap layer with geometry.

Referring now to FIGS. 25-27 test configurations 1-3 as discussed above, respectively, are repeated with additional variations on base layer 22, overwrap layer 23, and second overwrap layer 23*a*. In one variation, base layer 22 is non-reinforced self-amalgamating silicone tape wrapped in a single spiral along mandrel 5' using a 50% overlap between successive wraps of the tape. Connector strap 10 is positioned with back surface 13*d* in direct contact with base layer 22. Overwrap layer 23 is reinforced self-amalgamating silicone tape wrapped with geometry. That is, the tape of overwrap layer 23 is wrapped with four 100% overlapping revolutions, resulting in built-up region 23*b* adjacent first catch 12. Then, the tape continues in a spiral with 50% overlap towards second catch 14. Finally, the tape is wrapped in four 100% overlapping revolutions to result in another built-up region 23*b* adjacent second catch 14.

In a second variation, no base layer 22 is present on mandrel 5'. Connector strap 10 is positioned with back surface 13*d* in direct contact with mandrel 5'. Overwrap layer is reinforced self-amalgamating silicone tape wrapped with geometry—four 100% overlapping revolutions adjacent first catch 12 with built-up region 23*b*, then in a spiral with 50% overlap towards second catch 14, then wrapped four 100% overlapping revolutions adjacent second catch 14 resulting in a second built-up region 23*b* adjacent second catch 14.

In a third variation, base layer 22 is reinforced self-amalgamating silicone tape wrapped in a single spiral along mandrel 5' using a 50% overlap between successive wraps of the tape. Connector strap 10 is positioned with back surface 13*d* in direct contact with base layer 22. Overwrap layer is reinforced self-amalgamating silicone tape wrapped with geometry—with four 100% overlapping revolutions adjacent first catch 12, then in a spiral with 50% overlap towards second catch 14, then four 100% overlapping revolutions adjacent second catch 14.

In a fourth variation of test configuration 1 only, base layer 22 is Renfew friction hockey tape wrapped in a single spiral along mandrel 5' using a 50% overlap between successive wraps of the tape. Overwrap layer is reinforced self-amalgamating silicone tape wrapped with geometry—with four 100% overlapping revolutions adjacent first catch 12, then in a spiral with 50% overlap towards second catch 14, then four 100% overlapping revolutions adjacent second catch 14.

In a fifth variation of test configuration 1 only, base layer 22 is Easton pro-tack polyurethane cushioned grip tape wrapped in a single spiral along mandrel 5' using a 50% overlap between successive wraps of the tape. Overwrap layer is reinforced self-amalgamating silicone tape wrapped with geometry—with four 100% overlapping revolutions adjacent first catch 12, then in a spiral with 50% overlap towards second catch 14, then four 100% overlapping revolutions adjacent second catch 14.

In a sixth variation of test configuration 1 only, base layer 22 is DSP Lizard Skins durasoft polymer bat tape wrapped in a single spiral along mandrel 5' using a 50% overlap between successive wraps of the tape. Overwrap layer is reinforced self-amalgamating silicone tape wrapped with geometry—with four 100% overlapping revolutions adjacent first catch 12, then in a spiral with 50% overlap towards second catch 14, then four 100% overlapping revolutions adjacent second catch 14.

Figure 28:
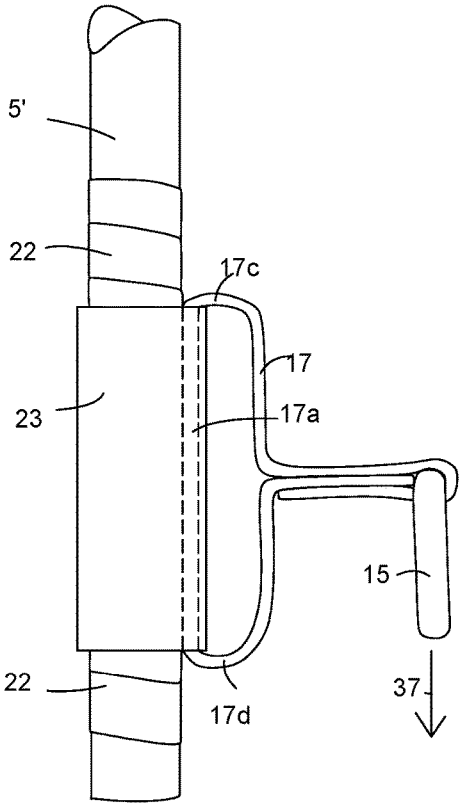
FIG. 28 illustrates test configuration 4 in which another embodiment of a connector strap is installed on an implement using a base layer without geometry and an overwrap layer of shrink tubing.
Figure 29:
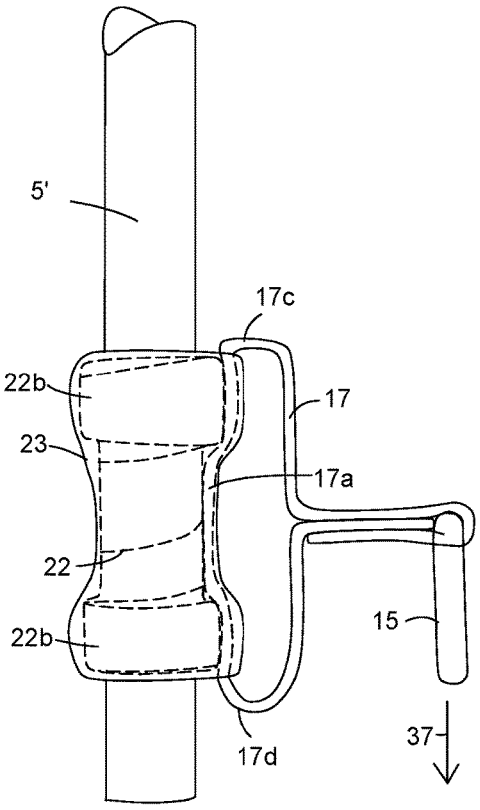
FIG. 29 illustrates test configuration 5 for the connector strap of FIG. 28 installed on the implement using a base layer with geometry and an overwrap layer of shrink tubing.

For these measurements with test configurations shown in FIGS. 27-29, failure of the tethering method is noted by either the connector strap 10 sliding relative to mandrel 5'

(e.g., along mandrel 5' or along base layer 22) or connector strap 10 tearing through overwrap layer 23. Table 5 below summarizes the results of failure of the attachment method with various base layers 22 and overwrap layer 23 with geometry as discussed above for FIGS. 25-27.

TABLE 5 measurements for tethering methods shown in FIGS. 25-27.

| Configuration | Base Layer | Overwrap layer | Second overwrap layer | Failure force (lbs) |
|---|---|---|---|---|
| Test configuration 1 | Non-reinforced self-amalgamating silicone tape | Reinforced self-amalgamating silicone tape with geometry | none | 319 |
| Test configuration 1 | none | Reinforced self-amalgamating tape with geometry | none | 166 |
| Test configuration 1 | Reinforced self-amalgamating silicone tape | Reinforced self-amalgamating silicone tape with geometry | none | 187 |
| Test configuration 1 | Renfew friction hockey tape | Reinforced self-amalgamating silicone tape with geometry | none | 151 |
| Test configuration 1 | Easton ProTack polyurethane cushioned grip tape | Reinforced self-amalgamating silicone tape with geometry | none | 229 |
| Test configuration 1 | DSP LizardSkins durasoft polymer bat tape | Reinforced self-amalgamating silicone tape with geometry | none | 284 |
| Test configuration 2 | Non-reinforced self-amalgamating silicone tape | Reinforced self-amalgamating silicone tape with geometry | none | 142 |
| Test configuration 2 | none | Reinforced self-amalgamating silicone tape with geometry | none | 119 |
| Test configuration 2 | Reinforced self-amalgamating silicone tape | Reinforced self-amalgamating silicone tape with geometry | none | 162 |
| Test configuration 3 | Non-reinforced self-amalgamating silicone tape | Reinforced self-amalgamating silicone tape with geometry | none | 294 |
| Test configuration 3 | none | Reinforced self-amalgamating silicone tape with geometry | none | 274 |
| Test configuration 3 | Reinforced self-amalgamating silicone tape | Reinforced self-amalgamating silicone tape with geometry | none | 213 |

Referring now to FIGS. 28 and 29, a connector strap 10 is made with webbing 13 forming a closed webbing loop 17 and including shrink tubing 26, where shrink tubing 26 is heat shrink tubing. Base layer 22 is applied on mandrel 5', which is a 1.05" bare steel cylindrical mandrel. In FIG. 28, test configuration 4, base layer 22 is applied without geometry. That is, non-reinforced self-amalgamating silicone tape is wrapped in a single spiral around mandrel 5' using a 50% overlap between successive wraps of the tape. In FIG. 29, test configuration 5, base layer 22 is applied with geometry. That is, non-reinforced self-amalgamating silicone tape is wrapped with four 100% overlapping revolutions to result in built-up region 22*a*, then in a spiral with 50% overlap along mandrel 5' a predefined distance of about one inch, then wrapped four 100% overlapping revolutions adjacent second catch 14 to result in another built-up region 22*a*. A portion 17*a* of closed webbing loop 17 is aligned with and positioned in direct contact with base layer 22. Portion 17*a* of closed webbing loop 17 extends along a non-linear path over base layer 22 and substantially takes the shape of base layer 22 as overwrap layer 23 is installed. Overwrap layer 23 is heat shrink tubing 26 installed over portion 17*a* of closed webbing loop 17 and base layer 22. Curves 17*c*, 17*d* of closed webbing loop 17 are catches of connector strap 10 that engage overwrap layer 23. A tensile force connected to connector 15 is applied axially downward from connector 15 and mandrel 5' as shown by arrow 37 at three inches per minute using the calibrated Chatillon LR30K materials testing machine. Failure of the tethering method is noted when connector strap 10 with shrink tubing 26 slides along base layer 22. Table 6 below summarizes the results of failure of the attachment method for a base layer 22 with and without geometry as illustrated in FIGS. 28-29.

TABLE 6 measurements for tethering methods shown in FIGS. 28-29.

| Configuration | Base Layer | Overwrap layer | Second overwrap layer | Failure force (lbs) |
|---|---|---|---|---|
| Test configuration 4 | Non-reinforced self-amalgamating tape without geometry | Shrink tubing | none | 203 |
| Test configuration 5 | Non-reinforced self-amalgamating tape with geometry | Shrink tubing | none | 247 |

As noted by the experiments above for various test configurations, using a base layer 22 between connector strap 10 and implement 5 (e.g., mandrel 5') significantly increases the force required to cause failure of the attachment method when a force is applied in the axial direction. The data above also indicate that installing base layer 22 or overwrap layer 23 with geometry increases the strength of the attachment of connector strap 10 to implement 5 before failure as compared to base layer 22 or overwrap layer 23 without geometry.

TABLE 7 drop tests with connector strap made of flat bungee cord or nylon webbing

| Configuration | Weight of Dropped Mandrel | Peak Force ($lb_f$): Nylon Webbing | Peak Force ($lb_f$): Flat Bungee |
|---|---|---|---|
| Connector strap of FIG. 4 | 8 lbs. | 387 | 194 ($1^{st}$ drop)<br>228 ($2^{nd}$ drop)<br>235 ($3^{rd}$ drop) |
| Connector strap of FIG. 4 | 12 lbs. | 504 | 289 ($1^{st}$ drop)<br>332 ($2^{nd}$ drop)<br>358 ($3^{rd}$ drop) |
| Connector strap of FIG. 4 | 15 lbs. | 611 | 336 ($1^{st}$ drop)<br>383 ($2^{nd}$ drop)<br>412 ($3^{rd}$ drop) |
| Connector strap of FIG. 4 | 20 lbs. | 665 | 411 ($1^{st}$ drop)<br>448 ($2^{nd}$ drop)<br>Fail ($3^{rd}$ drop) |

The data of Table 7 is from drop tests using a tapered mandrel with a weight from eight to twenty pounds for the purpose of evaluating the peak force of the drop when the connector strap is constructed with nylon webbing or with stretchable webbing, such as flat bungee cord. A connector strap as shown in FIG. 4 is attached to the tapered end of the mandrel using heat shrink tubing. No base layer was installed on the mandrel. The connector strap is made with about six to nine inches of webbing. In the case of stretchable webbing, the webbing is ¾" Secure-Tite flat bungee cord. For these drop tests, a 4-foot tether made of 1"-wide nylon webbing is connected to the connector strap at one end and connected to a load cell at the other end. The mandrel is dropped from 48 inches above the load cell for a total drop distance of 96 inches. The peak force of the dropped mandrel is measured by the load cell.

The data show in all cases that the measured peak force is reduced when the connector strap is made of flat bungee cord instead of nylon webbing. For an 8 lb. mandrel, the peak force was reduced by about 50% from 387 $lb_f$ to 194 $lb_f$ when flat bungee cord is used to make the connector strap instead of nylon webbing. For a 12 lb. mandrel, the peak force was reduced by about 43% from 504 $lb_f$ to 289 $lb_f$ when flat bungee cord is used to make the connector strap instead of nylon webbing. For a 15 lb. mandrel, the peak force was reduced by about 45% from 611 $lb_f$ to 336 $lb_f$ when flat bungee cord is used to make the connector strap instead of nylon webbing. For a 20 lb. mandel, the peak force was reduced by about 41% from 665 $lb_f$ to 411 $lb_f$ when flat bungee cord is used to make the connector strap instead of nylon webbing. As such, when the hand tool is tethered to the user, the drop forces felt by the user are reduced. Also, failure may be reduced in other components of a tethering apparatus when the connector strap 10 is made of a stretchable webbing instead of a substantially inelastic webbing made of nylon or the like. The reduction in peak force allows the user in some cases to tether a heavier hand tool without exceeding a predetermined peak force if the hand tool is dropped.

The data also show that repeated drops result in successively higher peak forces when connector strap 10 is made of flat bungee cord. This trend is believed to be due to partial failure or breakage of some elastic strands in the bungee cord on each drop, therefore resulting in the bungee cord connector strap having a reduced ability to counter and mitigate the drop forces.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A tool-tethering method comprising:

providing a hand tool to be tethered, the hand tool having a longitudinal portion;

installing a base layer along the longitudinal portion of the hand tool to be tethered;

providing a connector strap assembly comprising:

a closed-loop connector;

a length of shrink tubing in an expanded state and capable of assuming a reduced state; and a length of webbing secured to the closed-loop connector and defining a closed loop extending through the length of shrink tubing;

installing the longitudinal portion of the hand tool into the length of shrink tubing with the length of shrink tubing substantially centered axially along the base layer and with a portion of the length of webbing positioned between the longitudinal portion of the hand tool and an inside surface of the length of shrink tubing; and causing the shrink tubing to assume the reduced state to provide a snug fit around the longitudinal portion of the hand tool, the portion of the length of webbing, and the base layer, thereby securing the connector strap assembly to the hand tool.

2. The method of claim 1, wherein the base layer comprises one of non-reinforced self-amalgamating tape, reinforced self-amalgamating tape, handlebar tape, hockey tape, adhesive cloth tape, or polymer grip tape, and wherein the step of installing the base layer comprises wrapping the longitudinal portion of the tool with the base layer.

3. The method of claim 2, wherein the step of installing the base layer further comprises:

forming a first built-up region by wrapping the self-amalgamating tape a plurality of overlapping wraps; and wrapping the self-amalgamating tape in a spiral from at least one side of the first built-up region along the longitudinal portion of the tool.

4. The method of claim 3, further comprising:

forming a second built-up region by wrapping the self-amalgamating tape a plurality of overlapping wraps a distance from the first built-up region.

5. The method of claim 1, wherein the step of providing the connector strap assembly includes selecting the length of webbing from the group consisting of webbing with a backing layer, coated webbing, nylon, rubber, flat bungee cord, and elastic webbing.

6. The method of claim 1, wherein the length of webbing includes a backing layer on a surface of stretchable webbing.

7. The method of claim 1, wherein the length of shrink tubing is selected from (i) heat-shrink tubing and (ii) cold-shrink tubing in a radially expanded state supported by a removable hollow core.

8. The method of claim 1 further comprising attaching a tether to the closed-loop connector.

9. A tethering method for a hand tool comprising:

providing a hand tool to be tethered, the hand tool having a longitudinal portion;

providing a quantity of tape;

providing an overwrap member;

providing a connector strap assembly comprising:

a closed-loop connector; and a length of webbing with a first end, a second end, and a body portion, wherein the first end is looped through the closed-loop connector and secured to the body portion adjacent the closed-loop connector thereby securing the closed-loop connector to the length of webbing and defining a first catch adjacent the body portion, and wherein the second end is folded on itself and secured to the body portion thereby defining a second catch adjacent the body portion and spaced apart from the first catch;

wrapping the tape around the longitudinal portion of the hand tool with at least a portion overlapping to form a first built-up region relative to a remaining portion of the tape, thereby forming a taped tool region;

positioning the connector strap with the body portion axially aligned with the taped tool region and with the first catch and the second catch facing away from the taped tool region; and installing the overwrap member around the body portion of the connector strap and the corresponding taped tool region, including the first built-up region, thereby securing the connector strap assembly to the hand tool.

10. The tethering method of claim 9, wherein the step of providing tape includes selecting the quantity of tape as self-amalgamating tape.

11. The tethering method of claim 9, wherein the step of providing the overwrap member includes selecting the overwrap member from the group consisting of self-amalgamating tape, a length of heat-shrink tubing, a length of rubber tubing, and a length of cold-shrink tubing in a radially expanded state supported by a removable hollow core.

12. The tethering method of claim 11, wherein the step of wrapping the tape includes forming the first built-up region adjacent the first catch and forming a second built-up region adjacent the second catch.

13. The method of claim 9 further comprising:

providing a tether having a first tether end and a second tether end;

attaching the first tether end to the closed-loop connector; and attaching the second tether end to the user.

14. The tethering method of claim 9, wherein the step of wrapping the tape includes forming a second built-up region a distance from the first built-up region, the first built-up region being positioned proximate the first catch and the second built-up region being positioned proximate the second catch when the connector strap is aligned with the taped tool region.

15. A tethering method for a hand tool, comprising:

providing a hand tool to be tethered, the hand tool having a longitudinal portion;

providing a base layer;

providing a connector strap assembly;

providing an overwrap member;

wrapping the base layer around the longitudinal portion of the hand tool thereby forming a wrapped tool region, at least a portion of the base layer overlapping and being substantially aligned to form at least one built-up region relative to a remaining portion of the base layer in the wrapped tool region;

positioning the connector strap assembly to align with the wrapped tool region; and installing the overwrap member about at least a portion of the longitudinal portion, the at least one built-up region, and the connector strap assembly thereby securing the connector strap assembly to the hand tool.

16. The tethering method of claim 15, wherein the connector strap assembly comprises a closed-loop connector and a length of webbing with a first end, a second end, and a body portion, wherein the first end is looped through the closed-loop connector and secured to the body portion adjacent the closed-loop connector thereby securing the closed-loop connector to the length of webbing and defining a first catch adjacent the body portion, and wherein the second end is folded on itself and secured to the body portion thereby defining a second catch adjacent the body portion and spaced apart from the first catch.

17. The tethering method of claim 15, wherein the step of wrapping the base layer includes forming a second built-up region a distance from the first built-up region, the first built-up region being positioned proximate the first catch and the second built-up region being positioned proximate the second catch when the connector strap is aligned with the wrapped tool region.

* * * * *